US005485897A

United States Patent [19]

Matsumoto et al.

[11] Patent Number: 5,485,897

[45] Date of Patent: Jan. 23, 1996

[54] ELEVATOR DISPLAY SYSTEM USING COMPOSITE IMAGES TO DISPLAY CAR POSITION

[75] Inventors: Kimio Matsumoto, Moriguchi; Ichihiro Sawaike, Neyagawa; Atsuo Nishigakik, Moriguchi; Akitoshi Yamashita, Hirakata; Tomohiko Tsumura, Osakaseayama, all of Japan

[73] Assignees: Sanyo Electric Co., Ltd.; Fujitec Co., Ltd., both of Osaka, Japan

[21] Appl. No.: 389,619

[22] Filed: Feb. 15, 1995

Related U.S. Application Data

[63] Continuation of Ser. No. 156,074, Nov. 23, 1993, abandoned.

[30] Foreign Application Priority Data

| | | | |
|---|---|---|---|
| Nov. 24, 1992 | [JP] | Japan | 4-313165 |
| Nov. 25, 1992 | [JP] | Japan | 4-314705 |
| Mar. 15, 1993 | [JP] | Japan | 5-052774 |
| Mar. 15, 1993 | [JP] | Japan | 5-052775 |
| Mar. 15, 1993 | [JP] | Japan | 5-052776 |

[51] Int. Cl.[6] ..... B66B 3/02

[52] U.S. Cl. ..... 187/399; 187/397; 187/395

[58] Field of Search ..... 343/5, 4, 32, 40; 187/395, 396, 397, 398, 399

[56] References Cited

U.S. PATENT DOCUMENTS

| | | | |
|---|---|---|---|
| 3,891,792 | 6/1975 | Kimura | 178/5.8 R |
| 4,577,177 | 3/1986 | Marubashi | 340/19 R |
| 4,623,869 | 11/1986 | Marubashi | 340/19 R |
| 4,995,479 | 2/1991 | Fujiwara et al. | 187/135 |
| 5,042,620 | 8/1991 | Yoenda et al. | 187/124 |
| 5,194,702 | 3/1993 | Swonger et al. | 187/139 |

FOREIGN PATENT DOCUMENTS

| | | |
|---|---|---|
| 61-38111 | 8/1986 | Japan . |
| 3-182489 | 8/1991 | Japan . |
| 4-70230 | 11/1992 | Japan . |
| 2092105 | 8/1982 | United Kingdom . |
| 2148654 | 5/1985 | United Kingdom . |
| 2203568 | 11/1988 | United Kingdom . |

*Primary Examiner*—Peter S. Wong
*Assistant Examiner*—Robert Nappi
*Attorney, Agent, or Firm*—Nikaido, Marmelstein, Murray & Oram

[57] ABSTRACT

An elevator sysem having an elevator operation control unit 2 for controlling the upward or downward movement of an elevator car 6 and an image display unit 5 provided inside the car. The system comprises an image reproduction unit 1 for feeding a main image signal for forming a background image to the image display unit 5, a superimposition image production circuit 3 for producing a subimage signal for forming a floor indicating image based on a floor signal from the control unit 3, and an image composition unit 4 for combining the main image signal and the subimage signal into a composite image signal to superimpose the floor indicating image on the background image and feeding the composite image signal to the display unit 5.

15 Claims, 25 Drawing Sheets

ELEVATOR DISPLAY SYSTEM USING COMPOSITE IMAGES TO DISPLAY CAR POSITION

This application is a continuation of application Ser. No. 08/156,074 filed Nov. 23, 1993 now abandoned.

FIELD OF THE INVENTION

The present invention relates to elevator systems having elevator cars which are controlled for upward and downward movement by an elevator operation control unit and which are equipped with an image display unit in the interior.

BACKGROUND OF THE INVENTION

The passengers riding in an elevator car are usually not acquainted with one another, and the space avilable for passengers inside the elevator car is limited, so that when the car is crowded with many passengers, the passengers riding in close proximity to or in contact with one another feel uncomfortable or tensioned.

Accordingly, elevator cars are provided with contrivances for relieving stress, such as comfortable interior illumination and a system for furnishing music. Furthermore an elevator system has been proposed which includes an image display unit provided on a vertical wall in the interior of the elevator car for attracting the eyes of the passengers to alleviate stress (Examined Japanese Patent Publication HEI 3-182489).

With the conventional elevator system wherein the image display unit is installed in the elevator car, the passenger directs attention to images on the display unit without paying due attention to the floor indicator, possibly failing to get off the elevator car. Conversely, if focusing attention on the floor indicator, the passenger can not afford to enjoy images on the image display unit and will not be relieved of stress effectively. The conventional elevator system wherein the image display unit is provided on the interior vertical wall of the elevator car has another problem in that the display screen is not only difficult to watch depending on the position of the passenger inside the elevator car but also fails to arrest the eyes of many passengers.

The present inventors have explored the reason why the images on the display are unable to arrest the eyes of many passengers and consequently found this problem to be attributable largely to the fact that the images on the conventional display unit are irrelevant to the operation of the elevator although passengers pay attention to the operation of the elevator which involves the movement and position of the elevator car or the opening or closing of the doors.

SUMMARY OF THE INVENTION

An object of the present invention is to provide an elevator system wherein the screen of an image display unit is adapted to arrest the eyes of passengers to maintain an effect to relieve stress without the likelihood of the passenger failing to alight from the car in a timely fashion.

The present invention provides an elevator system which comprises an image reproduction unit for feeding a main image signal for forming a background image to the image display unit provided in the interior of an elevator car, a superimposition image production circuit for producing a subimage signal for forming a floor indicating image based on a floor signal from an elevator operation control unit, and an image composition unit for combining the main image signal and the subimage signal into a composite image signal to superimpose the floor indicating image on the background image and feeding the composite image signal to the image display unit.

The main image signal delivered from the image reproduction unit is fed via the image composition unit to the image display unit inside the elevator car to produce a background image on the display screen.

The elevator car is controlled for an upward and downward movement by a control signal from the elevator operation control unit. When the elevator car stops at a certain floor, a floor signal corresponding to that floor is fed from the operation control unit to the superimposition image production circuit, which in turn produces a subimage signal for forming an image indicating the floor where the car comes to a stop. The subimage signal is fed to the image composition unit and combined with the main image signal.

The resulting composite image signal is fed to the image display unit, which shows on its display screen the floor indicating image as super-imposed on the background image. Accordingly, the floor indicating image on the display screen changes in corresponding relation with the floor at which the elevator car comes to a stop, thus notifying the passenger of the number of that floor where the car stops.

With the elevator system of the present invention described above, the background image on the display unit removes stress from the passenger, and the floor indicating image superimposed on the background image enables the passenger to identify the floor concerned while permitting the passenger to enjoy the background image, consequently obviating the likelihood of the passenger failing to alight from the elevator car timely.

Another object of the present invention is to provide an elevator system in which images are displayed in corresponding relation with the operation of the elevator and thereby adapted to arrest the eyes of the passengers effectively.

The present invention further provides an elevator system having an elevator operation control unit for controlling the operation of an elevator car and an image display unit disposed inside the elevator car, the elevator system comprising an image source storage unit having recorded therein an image corresponding to the position of the elevator car in upward or downard movement, a video memory capable of storing at least two fields of image signal to be reproduced from the image source storage unit, and a control circuit for controlling signal writing to and reading from the video memory and feeding the read image signal to the image display unit.

The control circuit comprises means for obtaining data as to the position of the elevator car based on a position signal from the elevator operation control unit, means for reproducing from the image source storage unit an image signal of a recording area corresponding to the car position based on the position data obtained and writing the image signal to the video memory, and means for reading the signal from the video memory to prepare an image signal for one picture and feeding the image signal to the image display unit.

With the elevator system described above, the image source storage unit has recorded therein images which are changed for one another in corresponding relation with the position of the elevator car which is moving upward or downward. These images are a plurality of stil pictures assigned to the respective floors at which the car stops, or different kinds of animations assigned to the respective floors at which the car stops.

While the elevator car moves upward or downward under the control of the elevator operation control unit, the operation control unit feeds to the control circuit a position signal corresponding to the current position of the car. The control circuit obtains data as to the position of the car based on the position signal.

Based on the position data obtained, the control circuit reproduces an image signal of the recording area corresponding to the position of the car from the image source storage unit, and writes the image signal to the video memory. In the case of still pictures, at least two still pictures are written to the video memory which images are assigned to the two floors, these two floors being the floor immediately above and the floor immediately below the position of the car. Alternatively in the case of animations, at least two kinds of animations assigned to the two floors above and below the position of the car are written to the video memory over a plurality of fields including the field of the current time.

Under the control of the control circuit, the image signal is thereafter read from the video memory to prepare an image signal for one picture, and the signal is sent to the image display unit. In the case of still pictures, when the car is at rest, one of the two still pictures written to the video memory is selected in corresponding relation to the stop position of the car, while when the car is in travel, the two still pictures are combined in corresponding relation to the position of the car to prepare an image signal for one picture.

In the case of animations, when the car is at rest, one of two kinds of animations written to the video memory is selected in corresponding relation to the stop position of the car, and an image signal of the field in match with the current time is fed to the image display unit. While the car is in movement, two kinds of animations are combined together in corresponding relation to the position of the car and the current time to prepare an image signal for one picture.

Consequently, the image display unit shows images in corresponding relation to the movement and position of the car for the passenger to visually recognize the upward or downward movement of the car with reference to the images on the display unit.

With the elevator system embodying the present invention, images are displayed inside the elevator car in corresponding relation to the operation of the elevator, enabling the passenger to visually recognize the operation of the elevator. The eyes of the passenger are therefore effectively directed toward the display images for the relief of stress.

DETAILED DESCRIPTION OF EMBODIMENTS

Several embodiments of the present invention will be described below in detail with reference to the drawings.

First Embodiment

Figure 1:
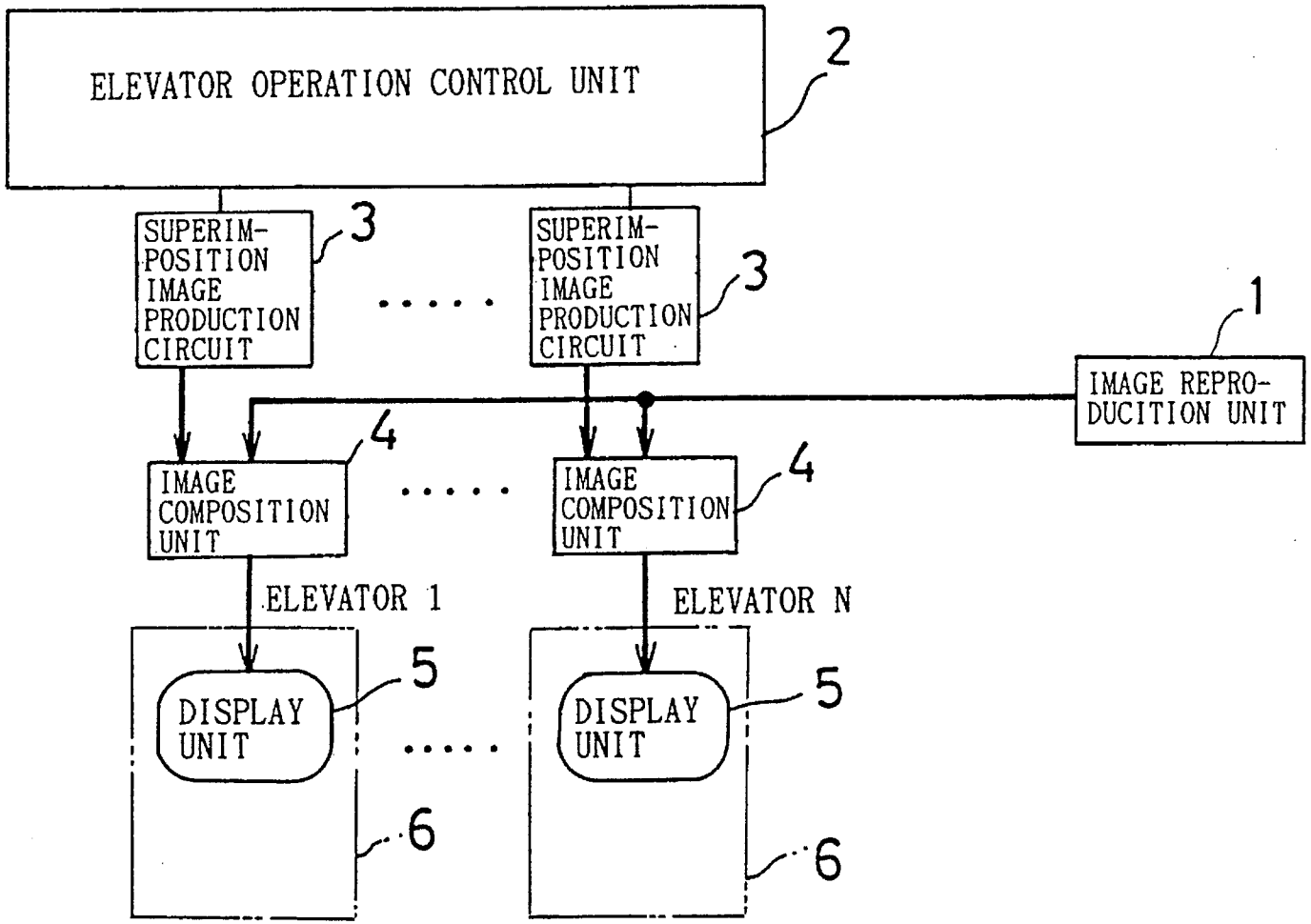
FIG. 1 is a block diagram showing the construction of an elevator system embodying the invention.

FIG. 1 schematically shows the construction of an elevator system. A plurality of elevator cars 6 are controlled for upward and downward movement by an elevator operation control unit 2. An image reproduction unit 1 provided outside the cars 6 feeds a main image signal to image composition units 4 in parallel which units 4 are provided for the respective cars 6.

On the other hand, the control unit 2 has connected thereto superimposition image production circuits 3 provided for the respective cars 6. A floor signal corresponding to the current position of each car 6 is fed to the corresponding circuit 3.

The superimposition image production circuit 3 prepares a subimage signal containing an image indicating the floor at which the car 6 has stopped, and feeds the signal to the corresponding image composition unit 4, which in turn combines the main image signal and the subimage signal together and feeds the resulting composite signal to an image display unit 5 inside the car 6.

Figure 2:
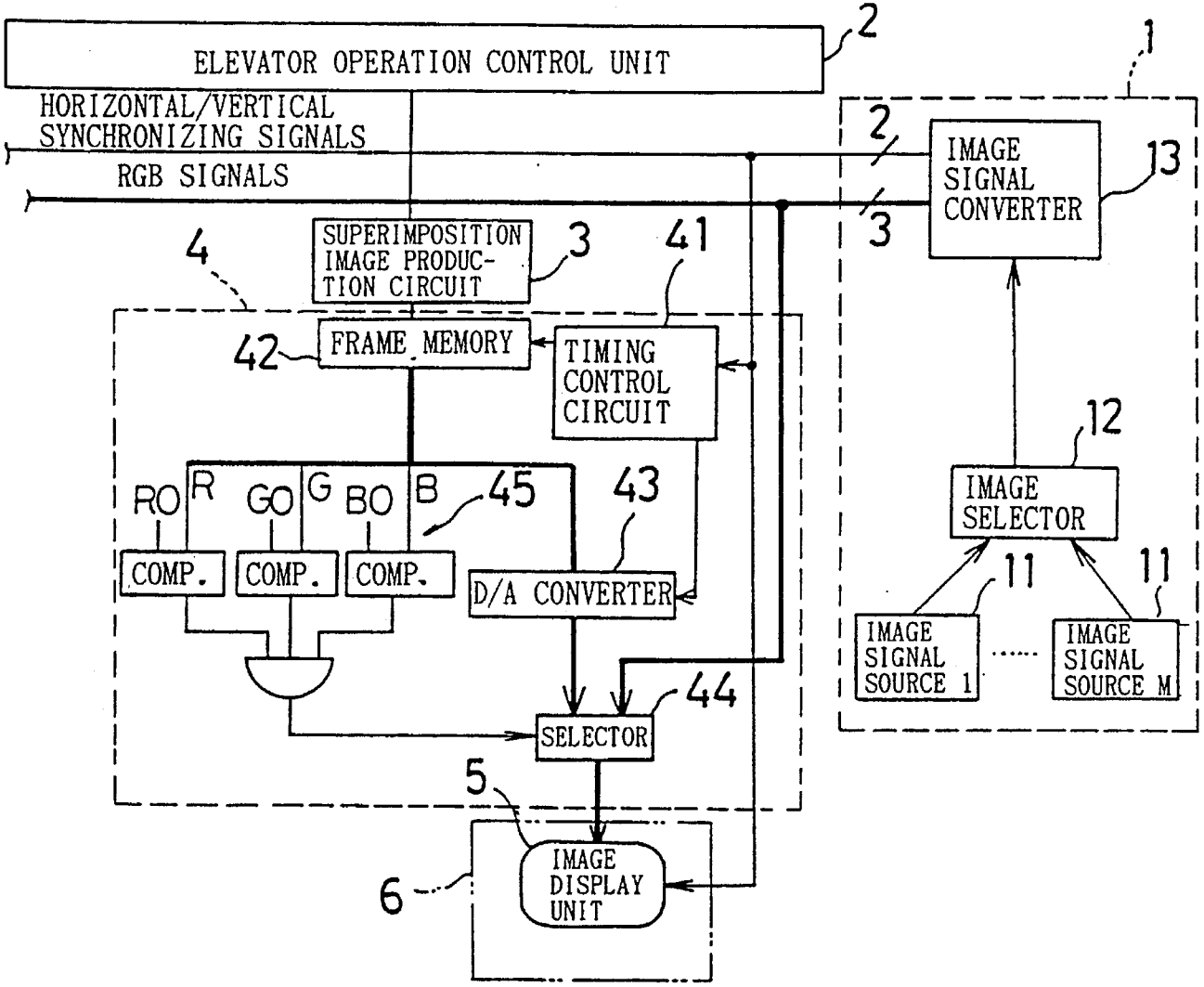
FIG. 2 is a block diagram showing the construction of an image reproduction unit and an image composition unit in detail.

FIG. 2 shows the construction of the image reproduction unit 1 and the image composition unit 4 in detail.

The image reproduction unit 1 comprises a plurality of image signal sources 11 each comprising a video tape recorder (VTR) or the like, an image selector 12 for selecting image signals from the signal sources 11, and an image signal converter 13 for preparing horizontal and vertical synchronizing signals and RGB signals from the selected image signals.

Figure 3:
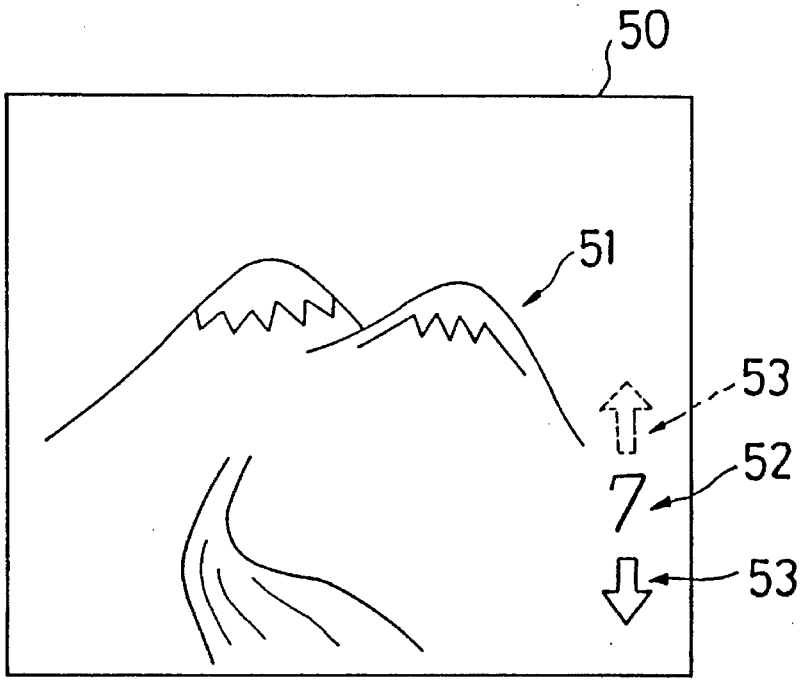
FIG. 3 is a front view showing an example of presentation on a display screen.

The subimage signal prepared by the super-imposition production circuit 3 is a digital signal, which contains as shown in FIG. 3 a floor indicating image 52 representing the current position (floor number) by a figure, and a direction indicating image 53 showing whether the car is in an upward movement or downward movement.

The composition unit 4 has a frame memory 42 for developing the subimage signal (RGB signals) from the circuit 3 into a display image. The image signal read from the frame memory 42 is converted to an analog signal by a D/A converter 43 and thereafter applied to an input terminal of a selector 44. The selector 44 has another input terminal to which the RGB signals from the reproduction unit 1 are fed.

The image composition unit 4 further has a timing control circuit 41 to which are fed the horizontal and vertical synchronizing signals from the reproduction unit 1. The circuit 41 controls signal reading from the frame memory 42 and the operation of the D/A converter 43.

The selector 44 is changed over by a comparison discriminating circuit 45 to which the RGB signals read from the frame memory 42 are fed. As illustrated, the circuit 45 comprises three comparators corresponding to the three respective color components R, G and B, and an AND circuit. Three reference signals R0, G0, B0 for R, G, B are fed to the respective comparators each at one input terminal, and R signal, G signal and B signal read from the frame memory 42 are fed thereto each at another input terminal. The two input signals are compared for matching or unmatching for every pixel. Each of the three reference signals R0, G0, B0 is set to the level of signal of pixel portion not containing the floor indicating image or direction indicating image, for example, the level of signal of black color among other signals from the frame memory 42.

Accordingly, when the three signals from the frame memory 42 are signals of pixel portion not containing the floor or direction indicating image, the outputs of all comparators are "1" representing matching, with the result that the output of the AND circuit also becomes "1" to switch the selector 44 for connection to the image signal converter 13.

On the other hand, when the three signals from the frame memory 42 are signals of pixel portion for forming the floor or direction indicating image, the output of at least one of the comparators becomes "0" indicating unmatching, with the result that the output of the AND circuit also becomes "0" to switch the selector 44 for connection to the frame memory 42.

By virtue of the change-over of the selector 44, the main image signal and the subimage signal are combined together for forming an image, and the resulting composite image signal is fed to the image display unit 5 inside the car 6. The unit 5 has the horizontal and vertical synchronizing signals fed thereto from the image signal converter 13 to present the image of the composite signal in accordance with the synchronizing signals. Consequently, the screen 50 of the display unit 5 shows the floor indicating image 52 and direction indicating image 53 as superimposed on a background image 51 as seen in FIG. 3.

This enables the passenger to recognize the floor with reference to the floor indicating image 52 while enjoying the background picture 51, thus obviating the likelihood of the passenger failing to alight from the car timely.

The elevator car 6 is internally provided with a sound output device (not shown) including a speaker, amplifier, etc. in combination with the display unit 5 to furnish music in conformity with the image.

Next, the position and posture in which the image display unit 5 is installed will be described.

Figure 4:
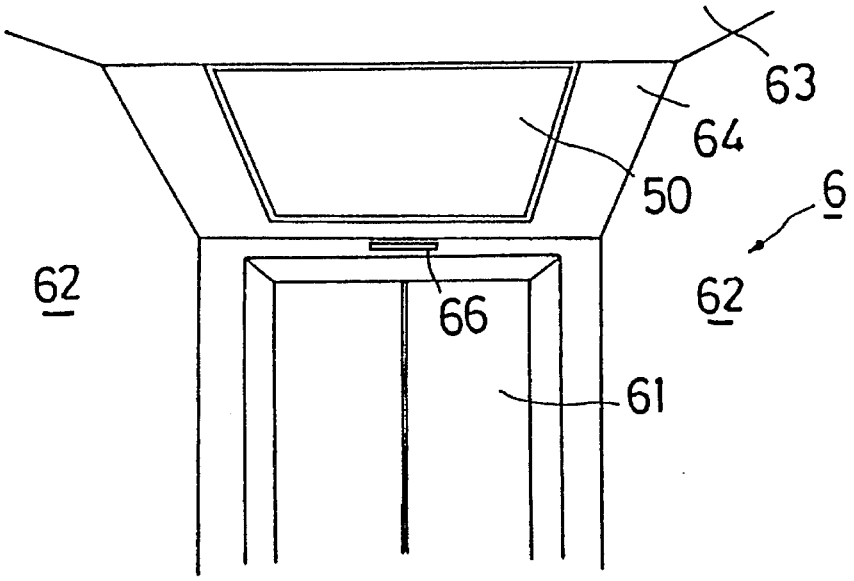
FIG. 4 is a perspective view showing the position and posture of the display screen inside an elevator car.

FIG. 4 shows an example, in which a wall 64 is provided inside the car 6 above entrance-exit doors 61. The wall 64 extends between opposite side walls 62, 62 and is inclined at a predetermined angle (e.g., 30 to 40 deg) with respect to a ceiling wall 63. A display screen 50 is installed in the inclined wall 64.

Accordingly, the passenger positioned in the car 6 and facing the doors 61 can direct his eyes to the display screen 50 approximately perpenducular thereto when turning the eyes obliquely upward while remaining in the same position to enjoy the image on the screen 50 without assuming a disagreeable posture.

In the example shown in FIG. 4, a floor indicator 66 is provided above the doors 61 as in the prior art. Both the indicator 66 and the screen 50 can be viewed by the passenger.

Figure 5:
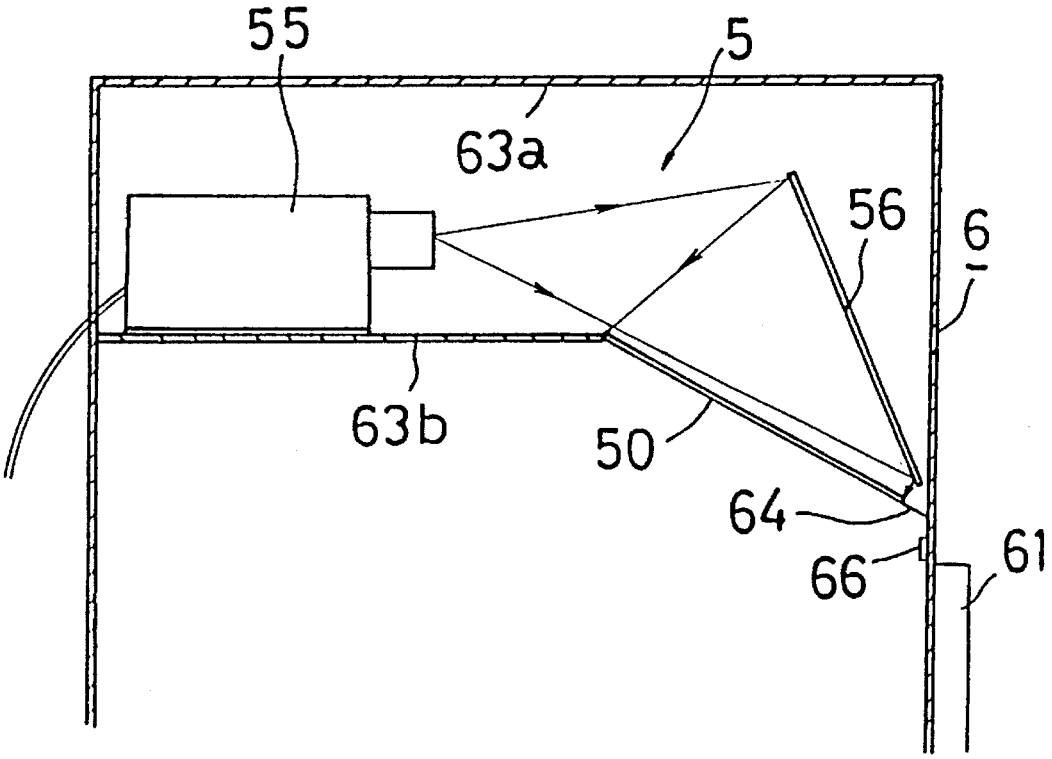
FIG. 5 is a side elevation partly broken away and showing an arrangement of image projector and light reflector which constitute an image display unit.

FIG. 5 shows an image display unit 5 which comprises an image projector 55 and a light reflector 56. The car 6 shown has a second ceiling **63*b* and a slanting wall 64 which are provided below a first ceiling 63*a*, and a display screen 50 which is installed in the wall 64 and on which images are projected from behind. The projector 55 is horizontally installed on the second ceiling 63*b* for projecting images on the screen 50 upon reflection at the reflector 56**.

With the arrangement shown in FIG. 5, a flat space is available between the first ceiling **63*a* and the second ceiling 63*b* to provide a sufficiently great optical path extending from the projector 55 to the screen 50 via the light reflector 56. The display screen 50** can therefore be of large size.

Figure 6:
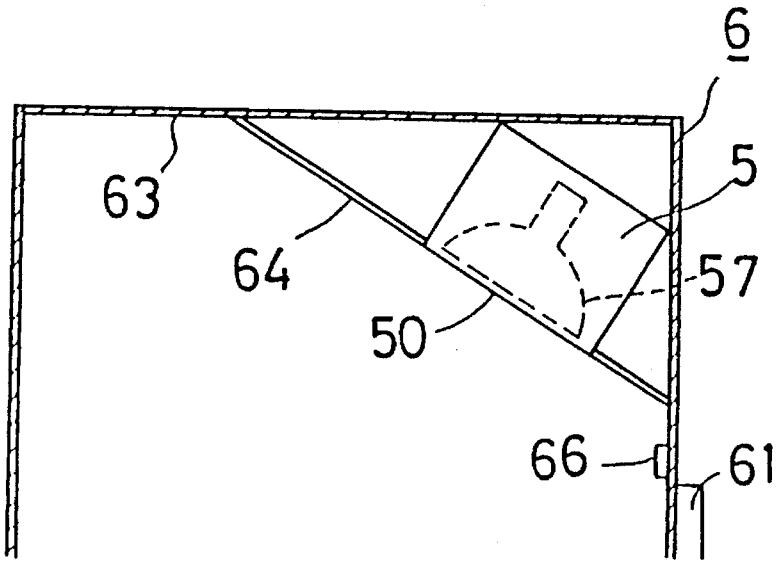
FIG. 6 is a side elevation partly broken away and showing the position of a CRT constituting an image display unit.
Figure 7:
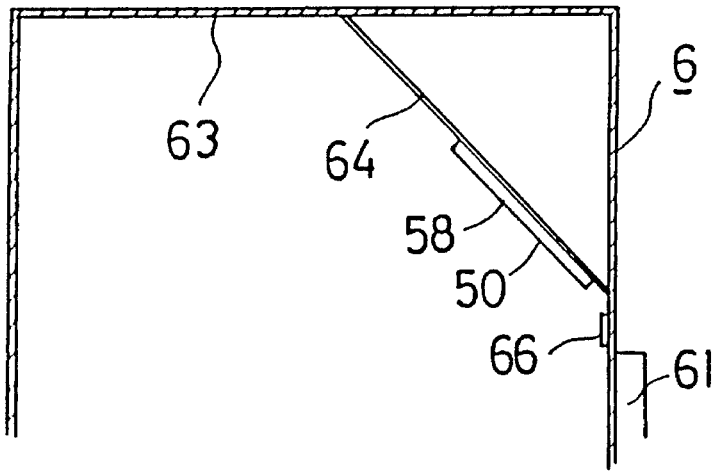
FIG. 7 is a side elevation partly broken away and showing the position of a liquid crystal display constituting an image display unit.

FIG. 6 shows an image display unit 5 comprising a CRT 57. In this case, a slanting wall 64 is attached directly to a ceiling wall 63, and the space between the ceiling wall 63 and the slanting wall 64 is utilized for the installation of the display unit 5. FIG. 7 shows an image display unit 5 which comprises a liquid crystal display 58.

In the case of the image projector 55 shown in FIG. 5 for projecting images from behind or the directly watchable liquid crystal display 58 of FIG. 7, there is a proper angle of field for the screen, and the screen appears dark and is difficult to view outside the proper angular range (proper visual field).

Figure 10:
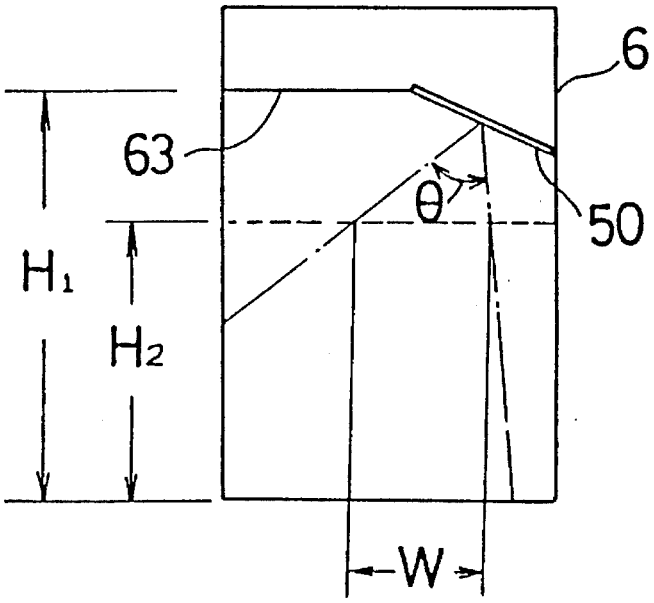
FIG. 10 is a diagram showing the proper visual field available in the case where the display screen is disposed as inclined with respect to the ceiling wall of the car.

However, in the case of the present invention wherein the display screen 50 is attached as inclined to a ceiling wall 63 about 2.5 m in height H1 as seen in FIG. 10, the region W included within the angle of field θ of the screen 50 at the height H2 of the passenger's eyes (about 1.6 to 1.7 m) is greater than in the case wherein the screen 50 is installed, for example, horizontally along the ceiling wall 63.

Figure 8:
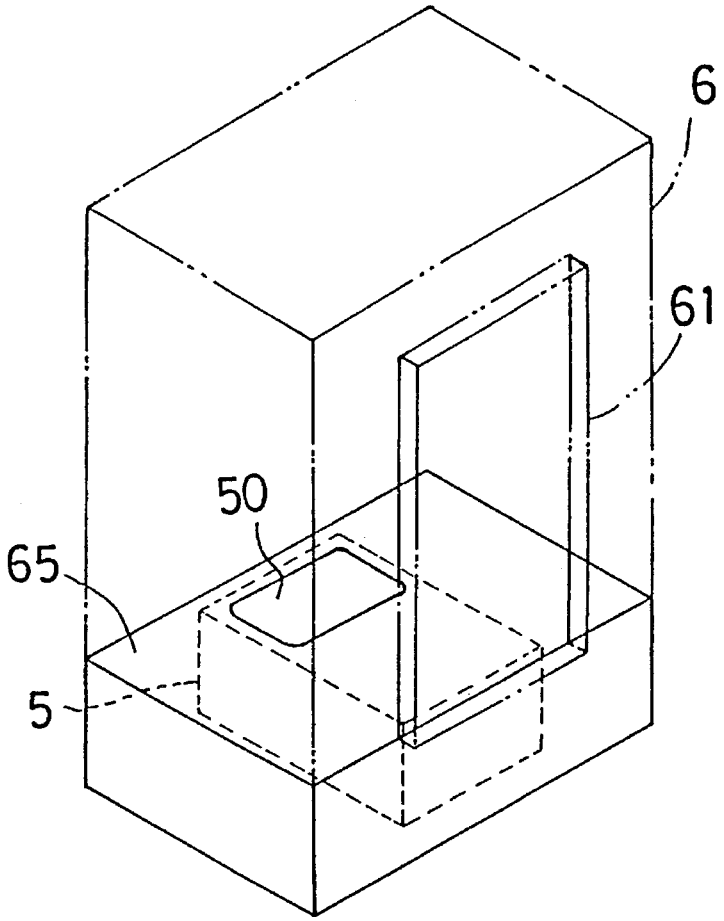
FIG. 8 is a perspective view showing an image display unit as disposed under the floor of an elevator car.
Figure 9:
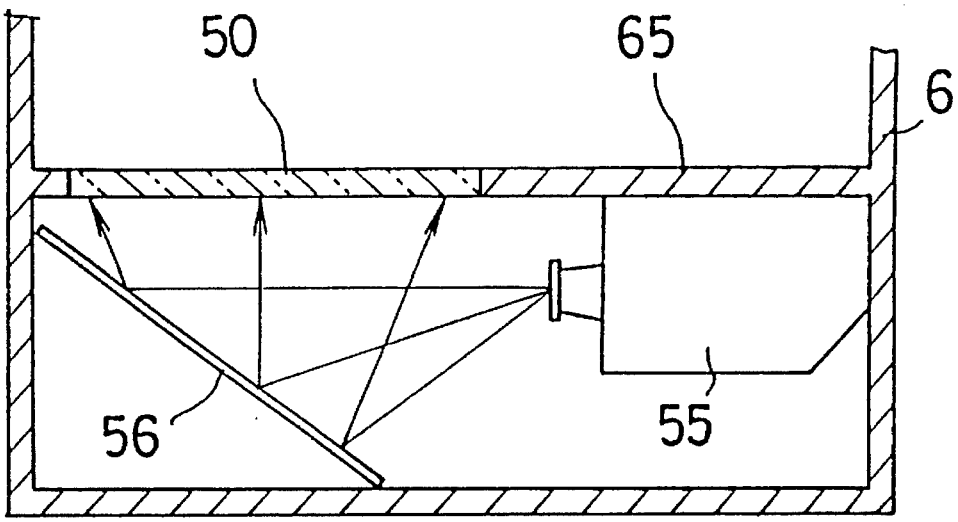
FIG. 9 is a side elevation partly broken away and showing the arrangement of an image projector and a light reflector which constitute the unit of FIG. 8.

FIGS. 8 and 9 show an image display unit 5 which comprises an image projector 55 and a light reflector 56 arranged under a floor 65 inside the car 6, and a display screen 50 installed in the floor 65 and facing vertically upward.

Figure 11:
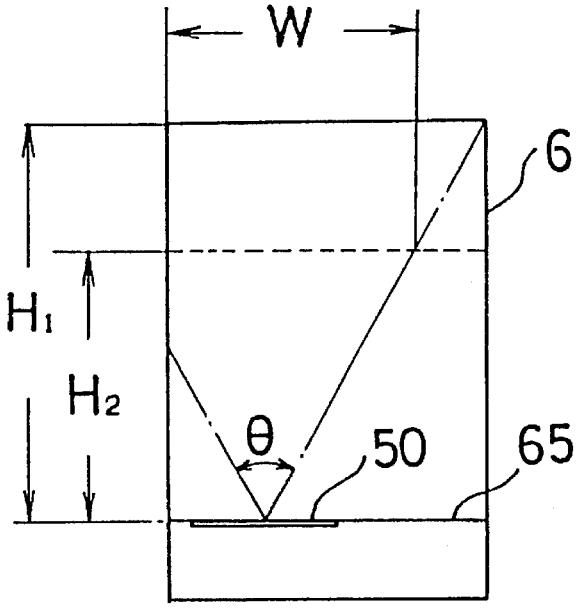
FIG. 11 is a diagram showing the proper visual field available in the case where the display screen is disposed in the floor.

In this case, the region W in which the height H2 of the passenger's eyes (about 1.6 to 1.7 m) is included in the angle of field θ as shown in FIG. 11 is still greater than in the case shown in FIG. 10.

Figure 12:
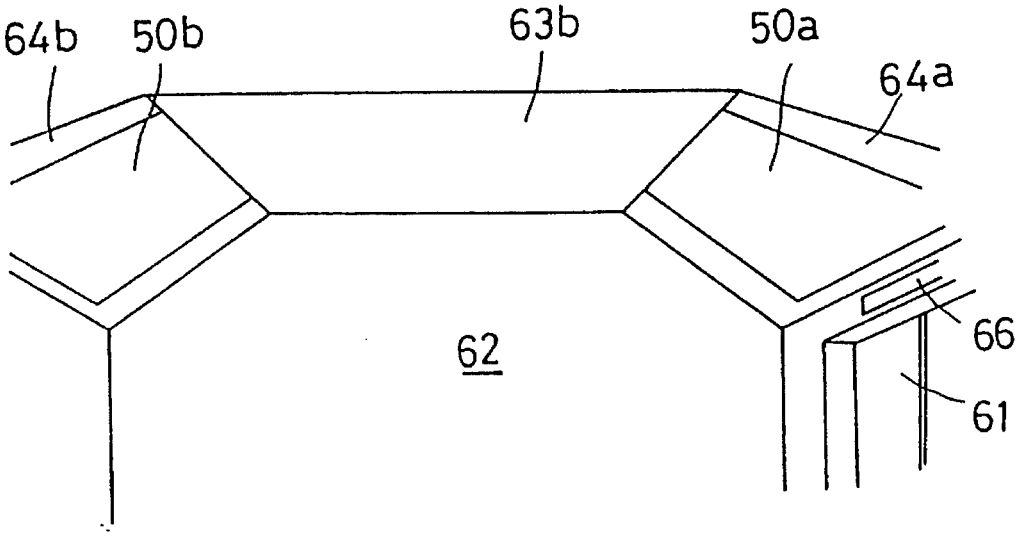
FIG. 12 is a perspective view of an embodiment adapted to display images on two screens.

FIG. 12 shows an example wherein a first slanting wall **64*a* is provided above the doors 61 inside the car 6, and a second slanting wall 64*b* is provided on the opposite side of the wall 64*a*, the walls 64*a*, 64*b* being provided respectively with display screens 50*a*, 50*b*** on which images are projected from behind.

Figure 14:
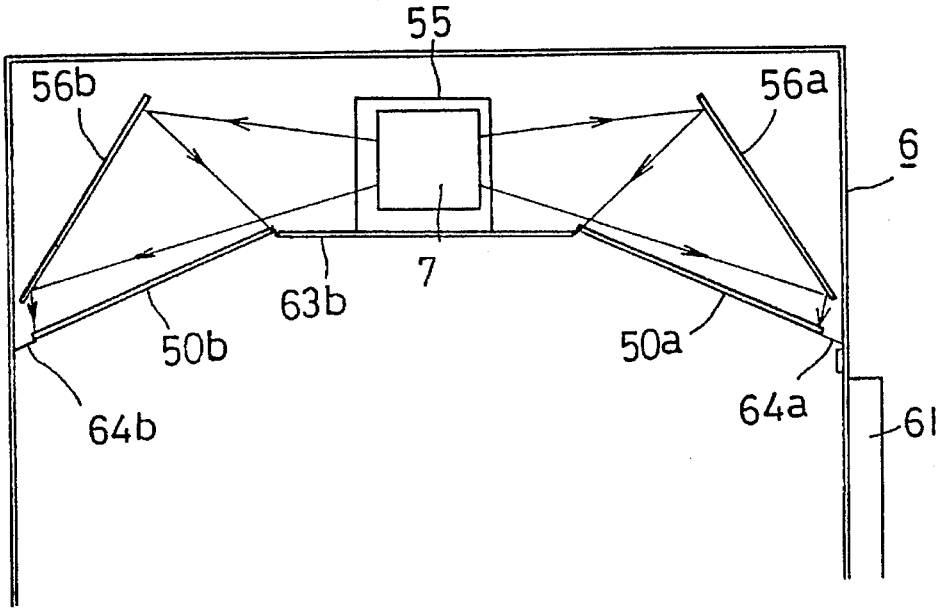
FIG. 14 is a side elevation partly broken away and showing an arrangement of optical system according to the embodiment of FIG. 14.
Figure 15:
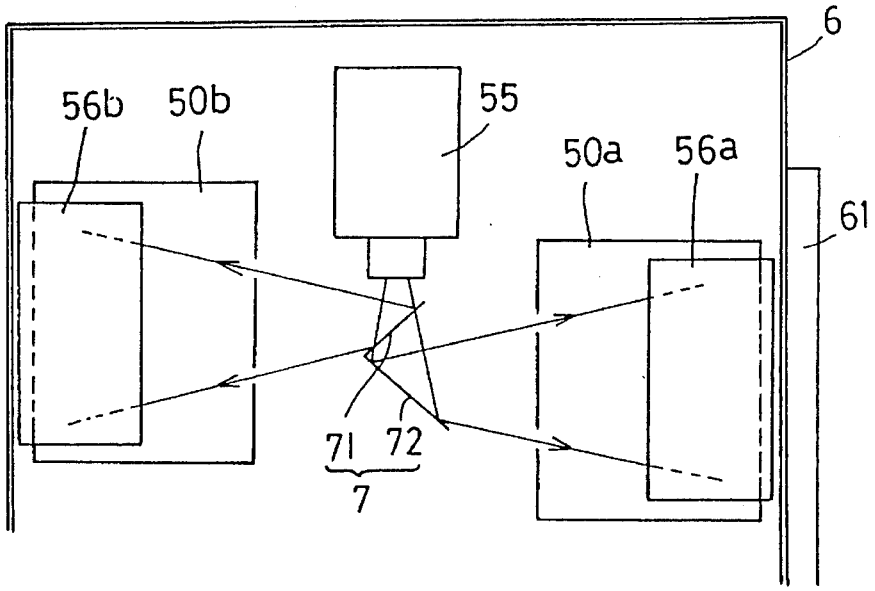
FIG. 15 is a plan view of the same.
Figure 16:
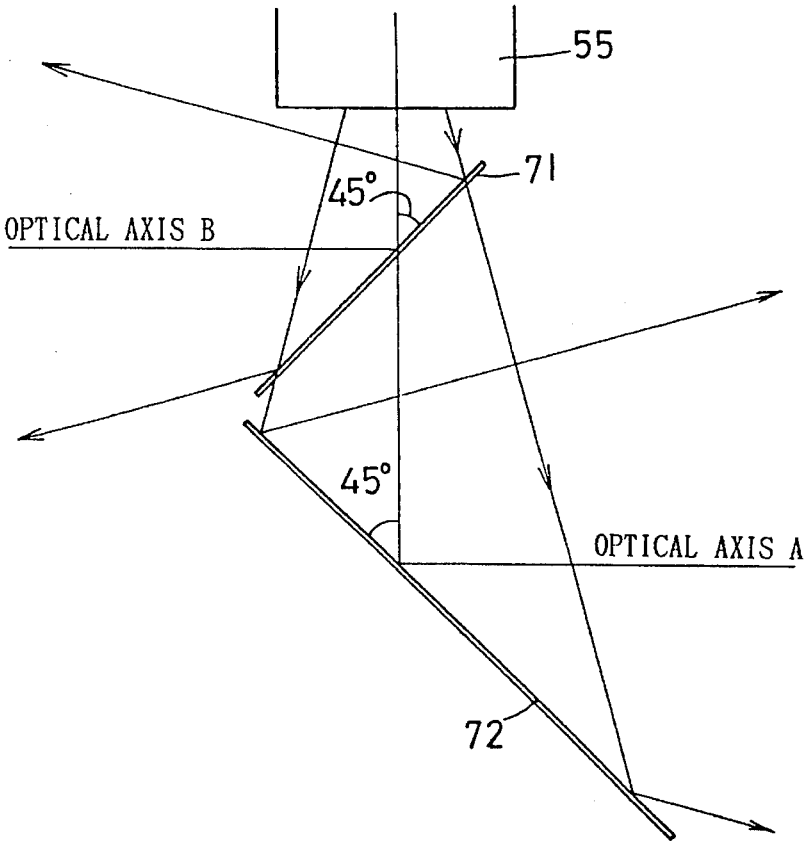
FIG. 16 is an enlarged fragmentary plan view of FIG. 15.

FIGS. 14 and 15 show an image projector 55 which is disposed on a second ceiling **63*b* horizontally for projecting images. The light of the image is divided by a light distributor 7 which comprises a half mirror 71 having a reflectance of 50%, and a mirror 72 having a reflectance of 100%. The image is then guided to the screens 50*a*, 50*b* by first and second light reflectors 56*a*, 56*b*. As shown in FIG. 16, the half mirror 71 and the mirror 72 are arranged at an angle of 45 deg with the optical axis of the projector 55** and face toward directions opposite to each other.

The image projected from the projector 55 is reflected at the half mirror 71 toward the direction of an optical axis B with 50% of the light intensity and reaches the second light reflector **56*b*. The image passing through the half mirror 71 with the remaining 50% light intensity is incident on the mirror 72, at which the image reflected toward the direction of an optical axis A to reach the first reflector 56*a***.

The position and angle of the first and second reflectors **56*a*, 56*b* are so adjusted that the image from the projector 55 is accurately formed on the display screens 50*a*, 50*b***.

The above arrangement presents the same image on the two display screens **50*a*, 50*b* which are inclined in different directions, enabling passengers to enjoy the same image in a comfortable posture with their eyes slightly turned upward and without directing the eyes toward one another when those standing close to the door 61 face toward a direction opposite to the door 61 and when those standing close to the innermost position face toward the door 61**.

Figure 17:
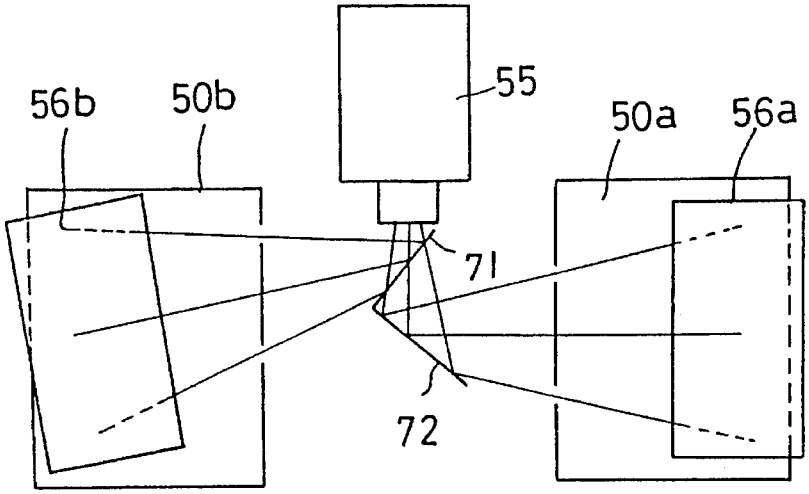
FIG. 17 is a plan view showing a modification of the arrangement of optical system shown in FIG. 15.

In the case of the above example, the difference between the half mirror 71 and the mirror 72 in position displaces the two display screens **50*a*, 50*b* from each other as seen in FIG. 15. Accordingly, the angle of inclination of the half mirror 71 and the orientation of the second reflector 56*b* are adjusted in the arrangement shown in FIG. 17 to position the two display screens 50*a*, 50*b*** as accurately opposed to each other.

Figure 13:
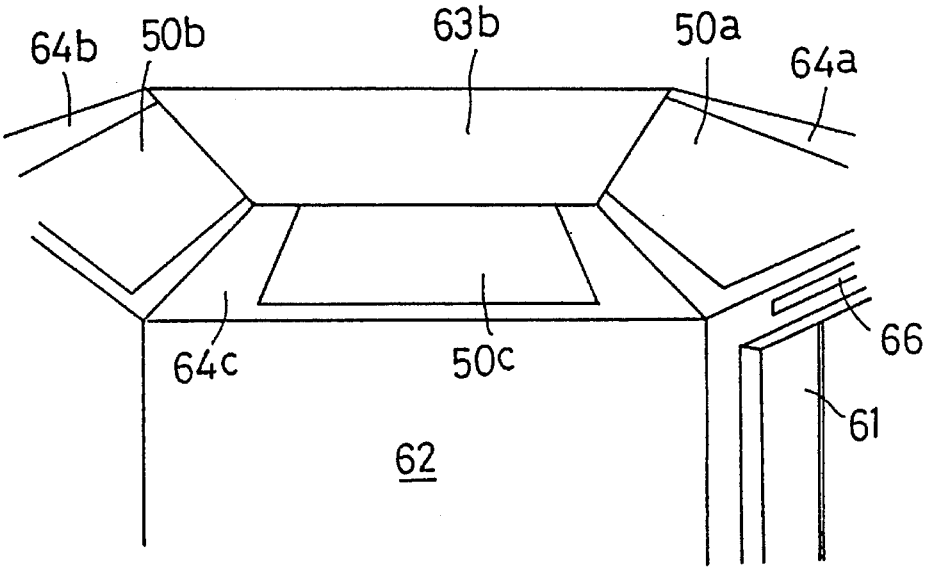
FIG. 13 is a perspective view of an embodiment adapted to display images on three screens.
Figure 18:
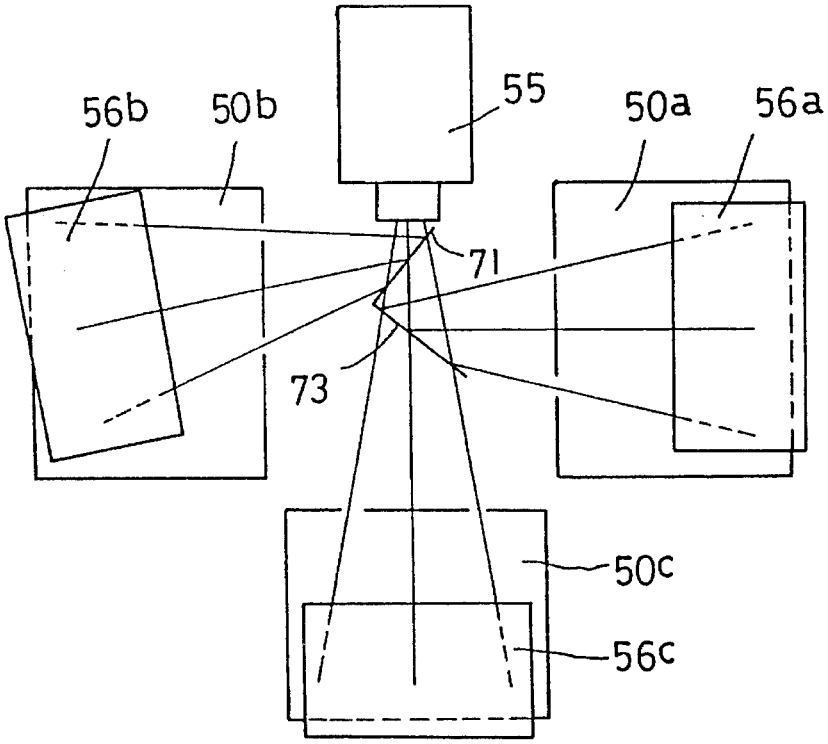
FIG. 18 is a plan view showing an arrangement of optical system according to the embodiment of FIG. 13.

FIG. 13 shows an arrangement wherein a third display screen **50*c* is installed in a slanting wall 64*c* provided above a side wall 62. As shown in FIG. 18, this arrangement includes a light distributor 7 which comprises two half mirrors 71, 73, whereby the light of the image projected from the image projector 55 is divided into three portions. The three images obtained by the division of light are reflected from light reflectors 56*a*, 56*b*, 56*c*, respectively, and guided to the three display screens 50*a*, 50*b*, 50*c*. The three screens can be made equal in luminance by giving a reflectance of about 33% to the first half mirror 71, and a reflectance of about 50% to the second half mirror 73**. Similarly, four or more screens can be used for displaying images.

The image composition unit 4 is not limited to the one shown in FIG. 2, but various known methods of superimposition are usable. The images to be superimposed on the background image 51 include, in addition to the floor indicating image 52 and direction indicating image 53, various images representing the state of the elevator during operation, such as a bar image corresponding to the velocity of upward or downward movement of the elevator car. Furthermore, the superimposition image production circuit 3 and image composition unit 4 shown in FIG. 2 can be arranged inside the car 6.

Second Embodiment

Figure 19:
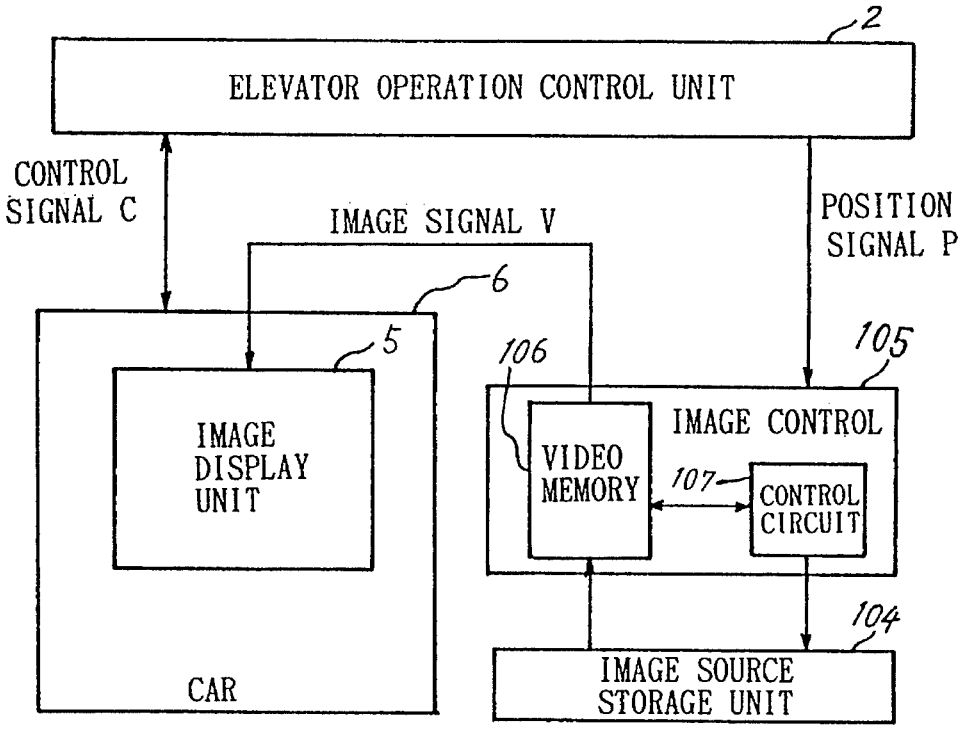
FIG. 19 is a block diagram showing the construction of an embodiment adapted to display different images when the car is at different positions.

FIG. 19 shows an elevator system comprising an image display unit 5 provided inside an elevator car 6 which is movable upward and downward by being controlled with a control signal C from an elevator operation control unit 2. The system further comprises an image source storage unit 104 having recorded therein images corresponding to varying positions of the car 6 in upward or downward movement, and an image control unit 105 for subjecting an image signal reproduced from the storage unit 104 to predetermined processing and feeding the resulting signal to the display unit 5.

The image source storage unit 104 comprises a hard disc device, CD-ROM device or like randomly accessible digital signal memory device, or a plurality of such devices. The image control unit 105 comprises a video memory 106 capable of storing a plurality of fields of image signal to be reproduced from the image source storage unit 104, and a control circuit 107 for controlling signal writing to and reading from the video memory 106.

The control circuit 107 is provided by the software of the microcomputer to be described below, and has the functions of obtaining data as to the position of the car 6 based on a position signal P from the elevator operation control unit 2, reproducing from the image source storage unit 104 an image signal of the recording area corresponding to the position of the car 6 based on the position data obtained to write the signal to the video memory 106, and reading the signal from the video memory 106 to prepare an image signal V for one picture and feed the signal to the image display unit 5.

The position data includes the number of the floor at which the car 6 stops and also data as to an intermediate position of the car 6 in travel.

The images to be displayed on the unit 5 can be still pictures or animations. A plurality of different still pictures for the respective floors where the car 6 stops are recorded in the image source storage unit 104. Alternatively, different kinds of animations for the respective floors are recorded in the storage unit 104 for a predetermined period of time. These still pictures or animations may be independent images for the different floors or in the form of a continuous image comprising images corresponding to the first floor to the top floor and joined together.

Figure 22:
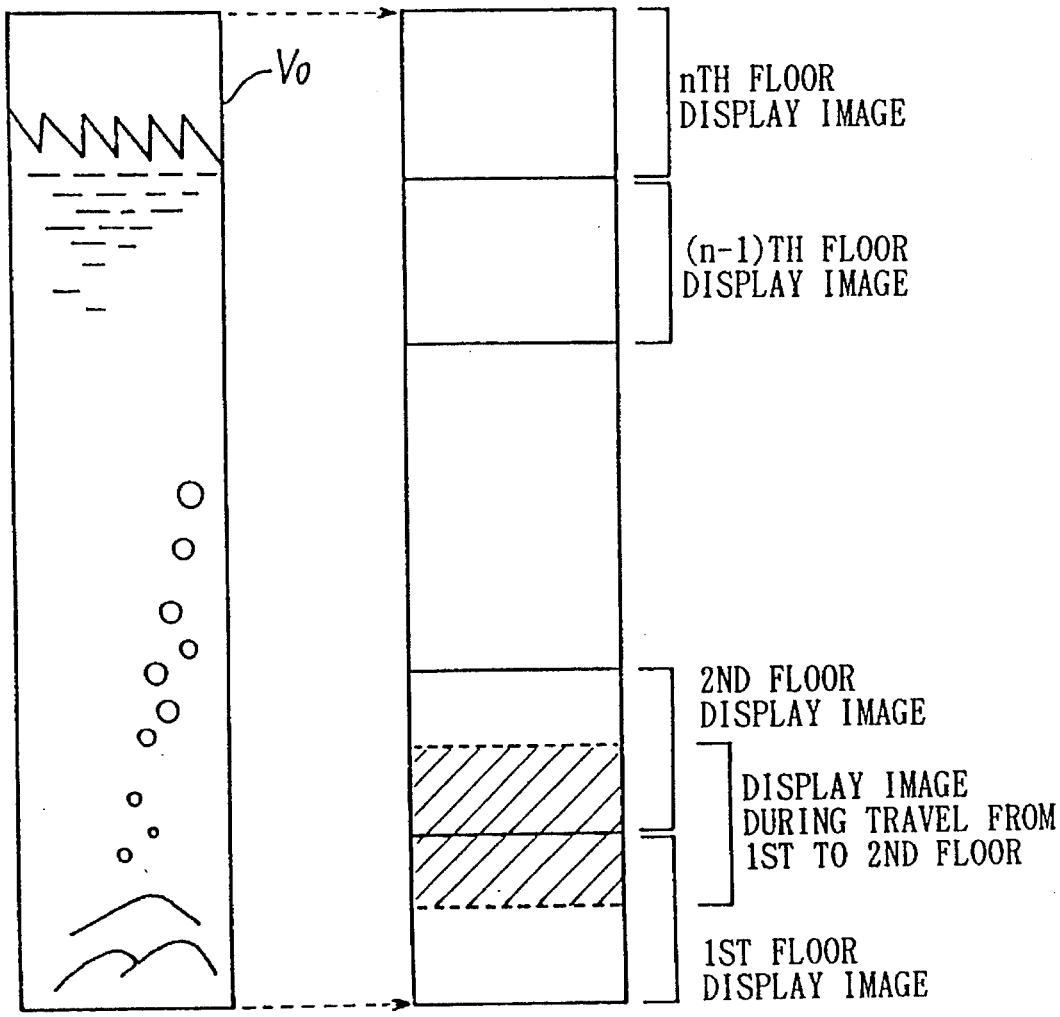
FIG. 22 is a diagram illustrating how display images are changed for one another in accordance with the position of the car in the embodiment.

FIG. 22 shows the relationship between an image V0 recorded in the image source storage unit in advance and still pictures to be displayed, i.e., images to be presented on the display unit during the movement of the car from the first floor to the nth floor. As illustrated, when the car has stopped at a certain floor, the still picture corresponding to that floor is selected and displayed.

Further while the car is in travel, display images for two floors are combined into a single still picture in corresponding relation to the current intermediate position of the car. The single still picture is prepared from a segment of each of the two display images which is cut off in corresponding relation to the position of the car, as illustrated by hatching. Alternatively, the two still pictures are reduced in scale in a ratio varying with the position of the car and combined into a single still picture. Thus, various known methods of edition are usable.

In the case of still pictures, therefore, the video memory 106 shown in FIG. 19 may have a capacity to store at least two fields of image signal. The control circuit 107 selects two fields of images corresponding to the position of the car from the images recorded in the storage unit 104, writes the image signal to the memory 106 and then prepare a composite image signal, for example, by controlling the read start address of the memory 106 or by subjecting the two fields of image signal to the specified image processing.

Figure 20:
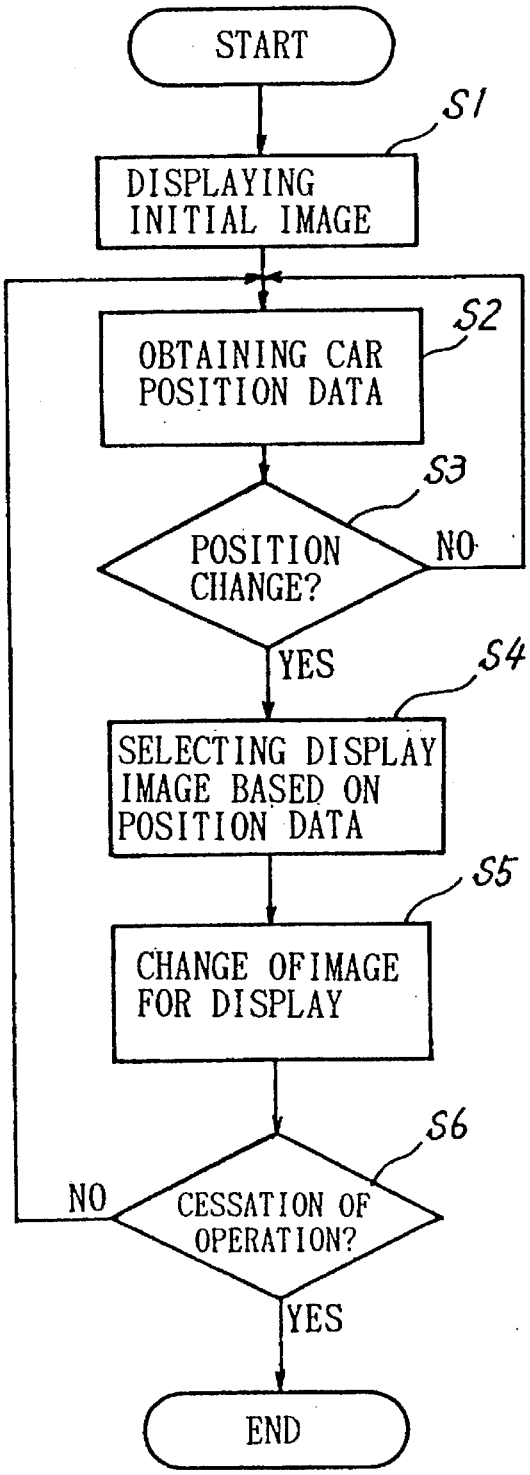
FIG. 20 is a flow chart showing an image control procedure for still pictures according to the embodiment.

FIG. 20 shows the basic control operation of the control circuit as to the still pictures.

While the elevator car is at rest at its stand-by position, i.e., first floor, an initial image is on the display unit (S1). When the car subsequently starts to move, data as to the position of the car is obtained (S2), and an inquiry is made as to a change in the position based on the position data obtained (S3). If the position has changed, the image to be displayed is selected from the image source storage unit based on the position data (S4) and the signal is written to the video memory. Next, signal reading from the video memory is controlled to display the image corresponding to the position of the car on the display unit by a change-over (S5). The above procedure is thereafter repeated until the operation of the elevator is discontinued (S6).

Figure 23:
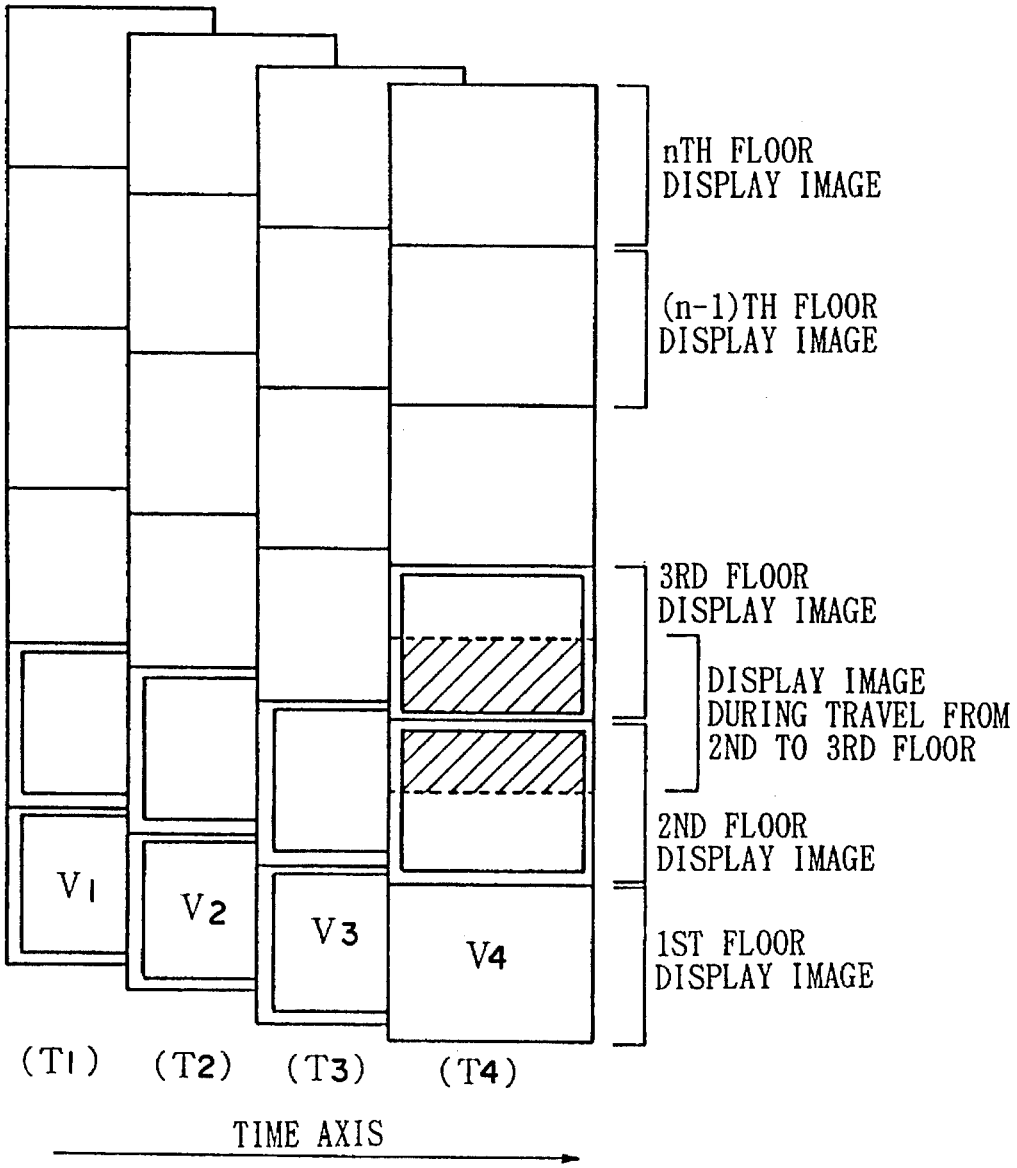
FIG. 23 is a diagram similar to the above in the case where the images are animated images.

FIG. 23 shows how animated images are changed over on the display unit with time and with the movement of the car.

While the car is at rest at a certain floor, the display unit shows images (V1, V2, V3, V4, . . . ) which are changed over with the lapse of time (T1, T2, T3, T4, . . . ).

During the travel of the car, display images for two floors are combined into one field of animation in corresponding relation to an intermediate position of the car. Suppose the car is in the course of movement from the second floor to the third floor at time T4 shown in FIG. 23. The display image for the second floor and the image for the third floor at this time are combined to show a composite image on the display unit. Various methods of edition can be used for the composition of images as is the case with the still pictures.

Figure 21:
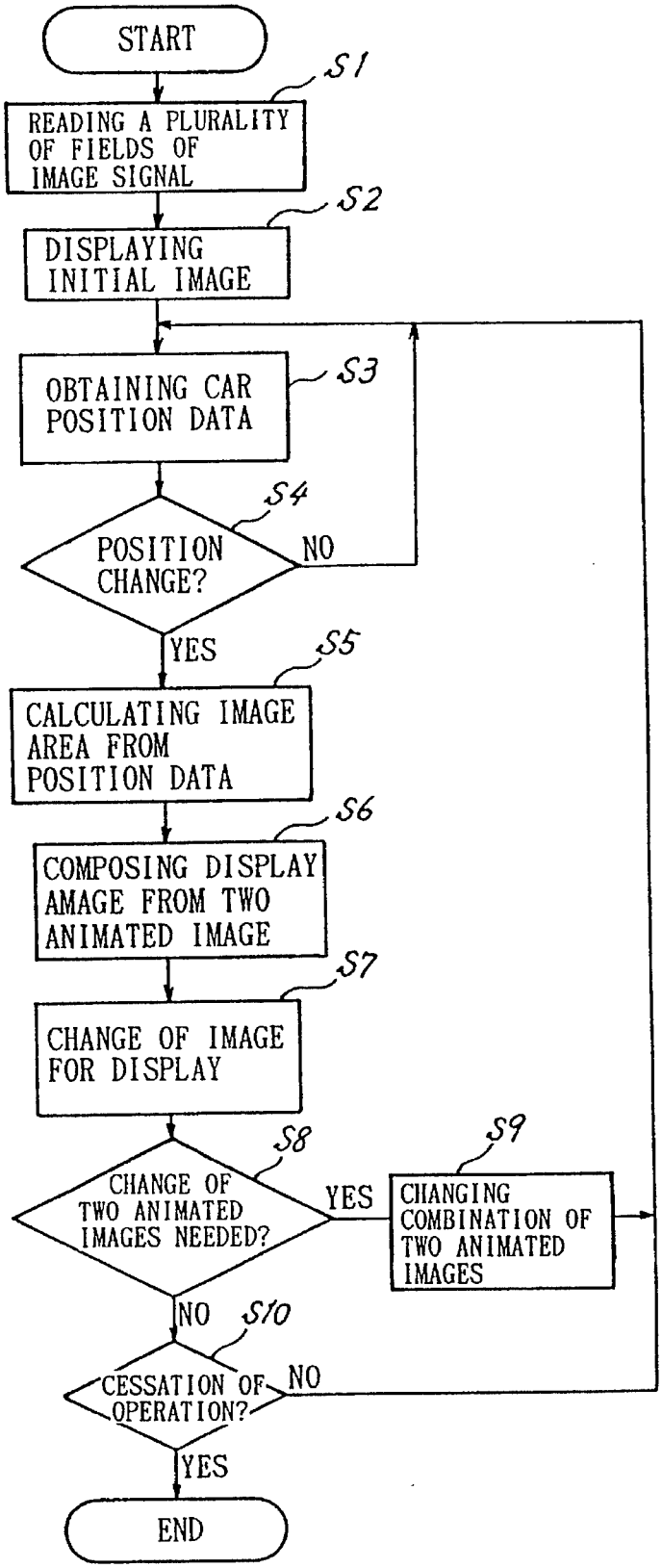
FIG. 21 is a flow chart showing an image control procedure for animations according to the embodiment.

FIG. 21 shows the operation of the control circuit for displaying animations. In the case of animations, the image signal varying with time is physically difficult to write to or read from the video memory on a real time basis. Accordingly, image signals of two animations corresponding to the position of the car are read from the image source storage unit in advance, each for a plurality of fields (e.g., about 10 fields) (S1). While the car is at its stand-by position, i.e., at the first floor, an initial image is displayed (S2).

In the case of animations, therefore, the video memory 106 shown in FIG. 19 requires a capacity to store a plurality of fields (e.g., about 10 fields) in the direction of time axis and at least two fields in the direction of movement of the car (e.g., a capacity of several megabytes).

When the car thereafter starts to move, position data is obtained (S3), and an inquiry is made as to a change in the position of the car based on the position data obtained (S4). If the position has changed, the image area to be displayed is calculated from two animations based on the position data (S5) to combine the two animations (S6), and the composition is shown on the display unit (S7). The animations are available by reading the images of current time from the video memory.

Subsequently, an inquiry is made as to whether the two animations need to be changed (S8). When the answer to the inquiry is in the affirmative, the combination of two animations is changed (S9), followed by step S3 again. If the change is not necessary, an inquiry is made as to whether the car has stopped (S10). The above procedure is repeated until the operation is discontinued.

The elevator system of the invention described above has the following feature. For example, the image display unit 5 shows an image of the sea bottom when the car 6 is at rest at the first floor and displays images of the sea closer to the surface of the sea as the car 6 rises. This makes the passengers feel as if they were rising in the sea.

Consequently, the passenger effectively directs attention to the display unit 5 and can be relieved of discomfort and tension given inside the car.

The position and posture in which the display unit 5 is installable are the same as those already described for the first embodiment, and will not be described again.

Third Embodiment

Figure 24:
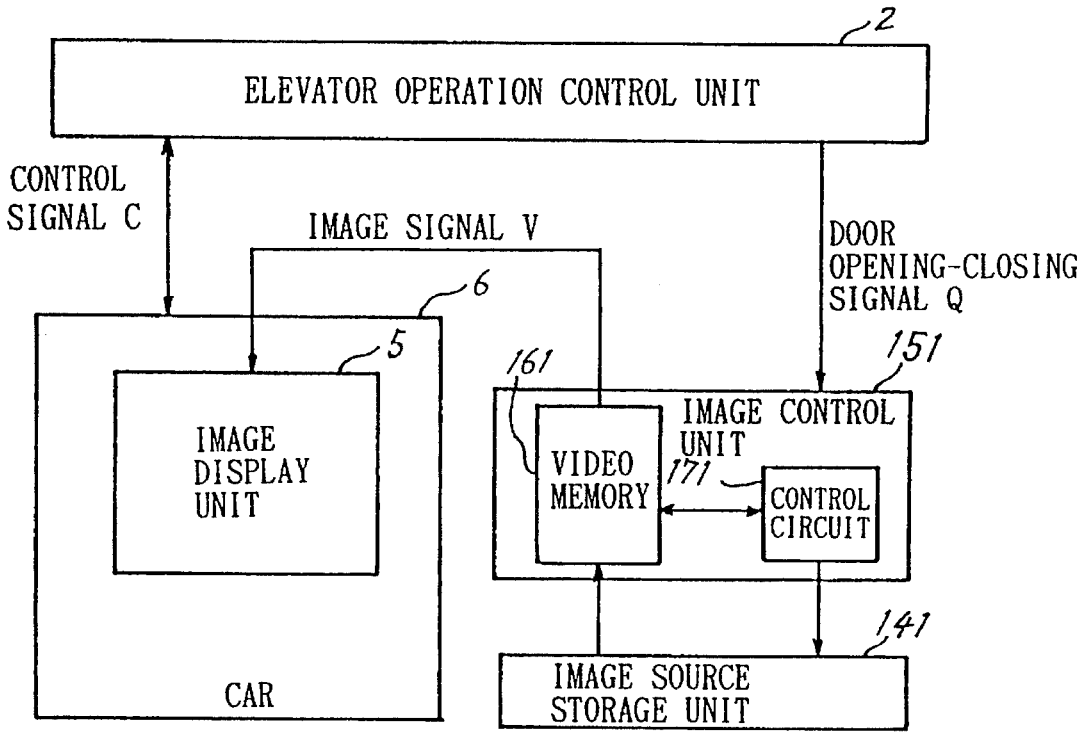
FIG. 24 is a block diagram showing the construction of an embodiment adapted to display images representing door opening and closing.

FIG. 24 shows an elevator system which comprises an image source storage unit 141 having recorded therein images representing the door opening and closing operation of an elevator car 6. The system has an image control unit 151 which comprises a video memory 161 capable of storing an image signal to be reproduced from the storage unit 141, and a control circuit 171 for controlling signal writing to and reading from the video memroy 161 and feeding the read image signal V to an image display unit 5.

The control circuit 171 is provided by the software of the microcomputer to be described below, and has the function of reproducing from the image source storage unit 141 an image signal of a recording area based on a door opening-closing signal Q obtained from an elevator operation control unit 2, the recording area corresponding to the signal Q, writing the image signal to the video memory 161, and reading the signal from the video memory 161 to prepare an image signal V for one picture and feed the signal to the image display unit 5.

The door opening-closing signal Q includes an opening signal which is produced with the start of door opening, and a closing signal which is produced with the start of door closing. When required, the signal further includes data indicating the time required for opening and closing.

Figure 26:
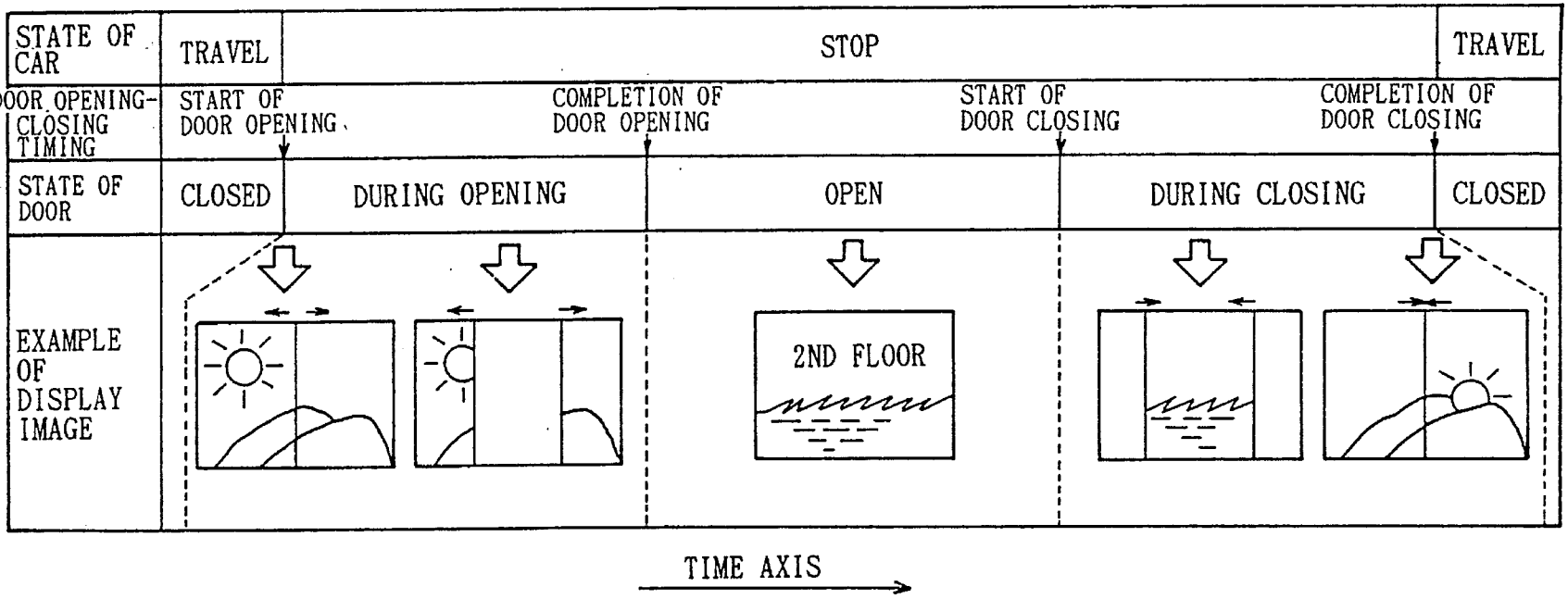
FIG. 26 is a diagram illustrating the images representing door opening and closing according to the embodiment.

FIG. 26 shows changes of images on the screen of the image display unit 5 with the door opening-closing operation of the car 6. When the doors start to open while the car 6 is at rest, the unit 5 displays on its screen an image showing the doors as closed. During the subsequent period until the doors fully open, the unit displays an image showing opening doors.

Further during opening, presented in the background portion between the doors is a background image including, for example, the number of of the floor at which the car 6 is at rest. When the doors are fully open, the background image is displayed over the entire area of the screen as illustrated.

The background image can be produced by the embodiment shown in FIGS. 19 to 23.

When the doors thereafter start to close, the display unit 5 displays an image showing the doors closing from the full-open state. When the doors then fully close, an image is displayed which shows fully closed doors. During this process, a composite image of doors and the background is also displayed.

The images showing the doors in the course of opening and closing can be prepared from the image showing the state before the doors open or close, by subjecting the image to known special image processing such as wiping processing timed with door opening or closing.

Figure 25:
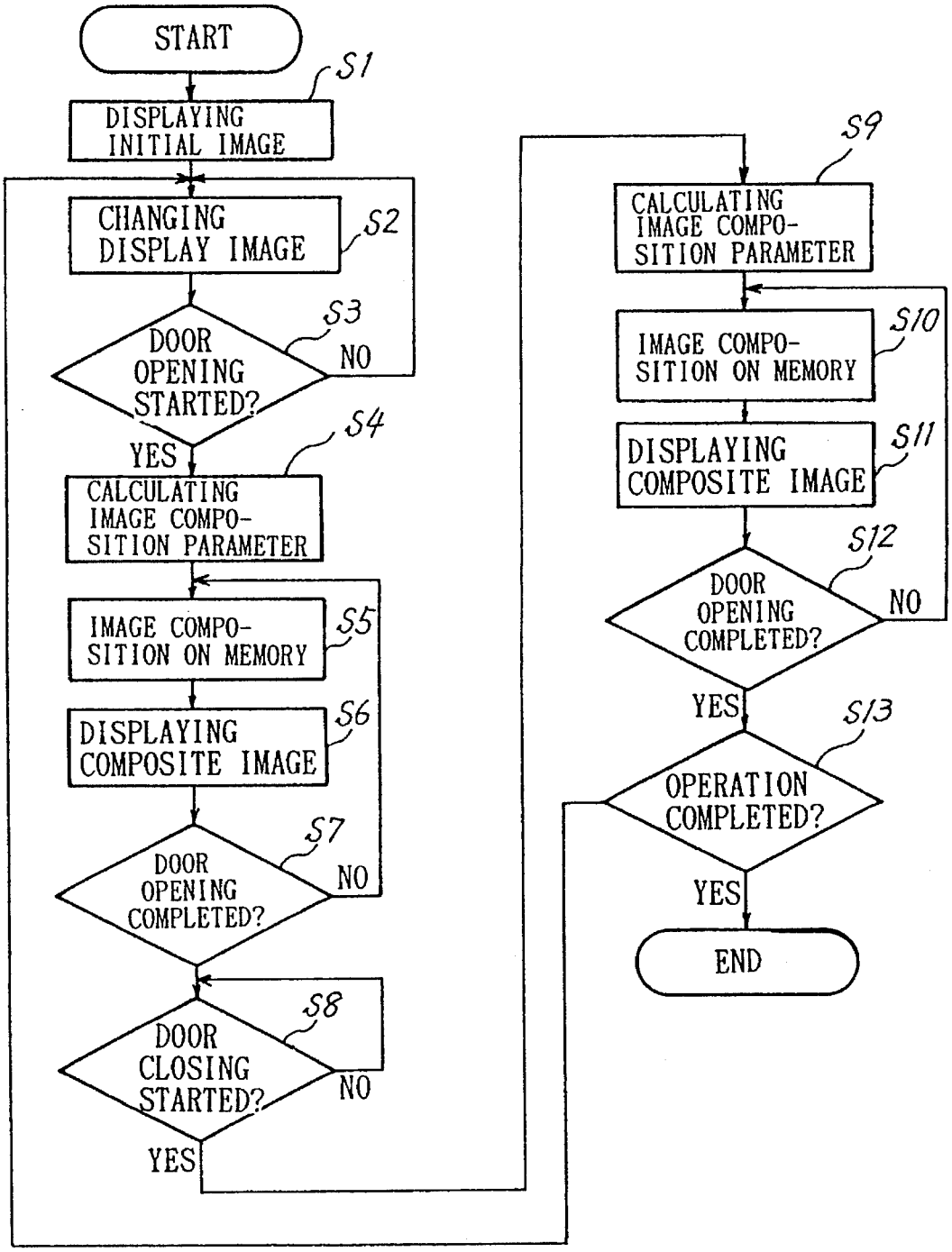
FIG. 25 is a flow chart showing an image control procedure according to the embodiment.

FIG. 25 shows the control procedure to be executed by the control circuit 71 to realize the operation described. When the elevator is started, the car 6 stops at the first floor which is its standby position, and an initial image is displayed on the unit 5 (S1). The car 6 thereafter starts to move. During the movement of the car 6, the image on display is changed in corresponding relation to the floor (floor number) at which the car 6 stops or which the car 6 moves past as in the foregoing embodiments (S2). For such changes of image, a simple change-over can be effected at a predetermined time interval.

In the above process, the control circuit 171 always monitors the door opening-closing signal Q from the elevator operation control unit 2. Upon detecting an opening signal with the car 6 at rest (S3), the circuit calculates an image composition parameter required for preparing a composite image from the door image and background image in accordance with the degree of opening of the doors determined from the door opening time (S4). The composite image is thus prepared on the video memory 161 (S5) and shown on the display unit 5 (S6). This procedure is repeated until the doors fully open (S7).

Subsequently, a closing signal is detected (S8), whereupon, an image composition parameter is calculated (S9) which is required for preparing a composite image from the background image and door image in accordance with the degree of opening of the doors determined from the door closing time. According to the result, the composite image is prepared on the video memory 161 (S10). This procedure is repeated until the doors fully close.

The control sequence is repeated until the operation of the elevator is completed (S13). In this way, the image display unit 5 presents images representing the operation of the doors during the door opening and closing periods, and an image corresponding to the floor at which the car stops when the doors are fully open as shown in FIG. 26.

The elevator system described enables the passenger to recognize the door opening movement upon the car coming to a stop while directing attention to the screen of the image display unit. This eliminates the likelihood of the passenger failing to alight from the car in a timely fashion.

Fourth Embodiment

Figure 27:
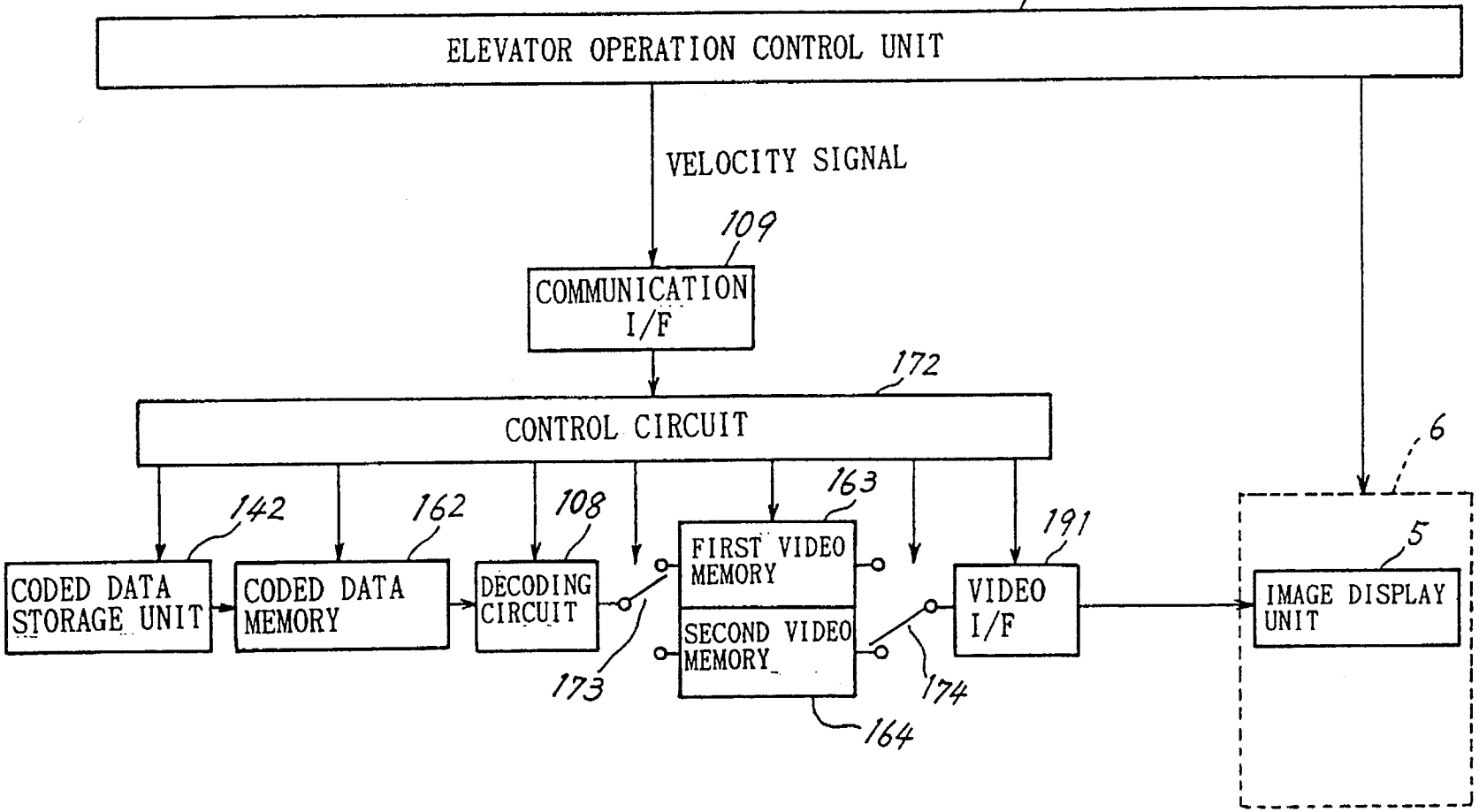
FIG. 27 is a block diagram showing the construction of an embodiment adapted to display images in accordance with the velocity of the car.

FIG. 27 shows an elevator system wherein an image display unit 5 shows an image matching ascending or descending sensation given to the passenger by the upward or downward movement of the elevator car 6, thereby enabling the passenger to visually predetect when the car 6 is to stop and to direct attention to the image more effectively owing to the impression or sensation given by the image.

A coded data storage unit 142 serving as an image source has recorded therein an image pickup signal of a video camera approaching a subject at a given relative velocity, the image pickup signal being recorded as highly efficiently coded for every frame number. The data storage unit 142 comprises a hard disc device, CD-ROM device or like randomly accessible digital signal memory device.

Assuming that the velocity of the subject and the video camera relative to each other is V0 during image pickup, the apparent approaching velocity V of the subject during signal reproduction can be expressed by Equation 1 given below.

Equation 1

$$V=V0\times(f/f0)$$

wherein f0 is the frame rate for image pickup, and f is the frame rate for reproduction and is a value not greater than a predetermined maximum reproduction rate fmax.

Accordingly, if the frame rate for reproduction is increased at a given variation rate, the subject obtained by signal reproduction appears approaching as if it were accelerated. Conversely, if the frame rate for reproduction is decreased at a given variation rate, the subject obtained by signal reproduction appears approaching as if it were decelerated.

Figure 29:
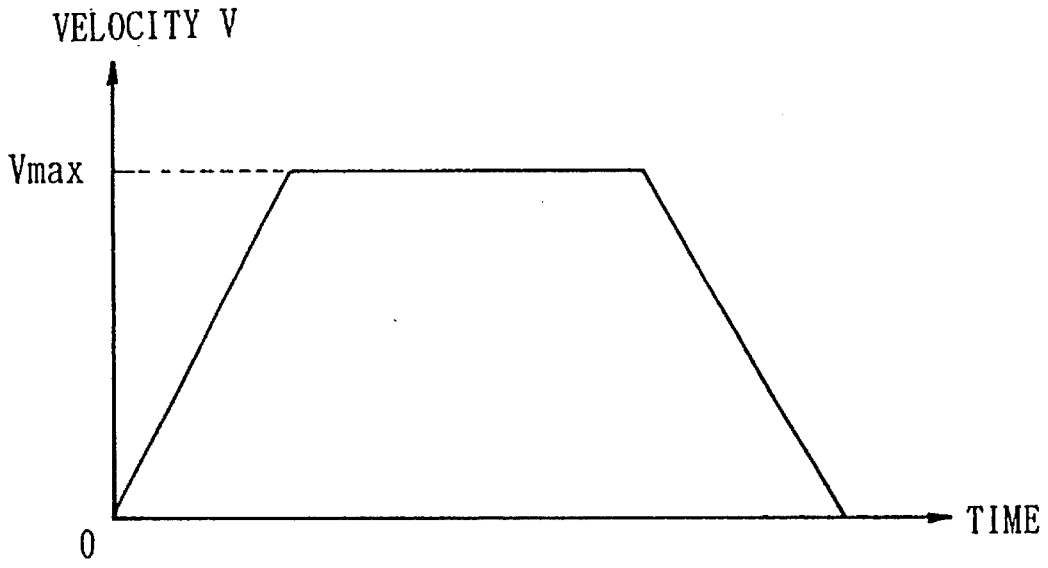
FIG. 29 is a graph showing variations in the velocity of the car.
Figure 30:
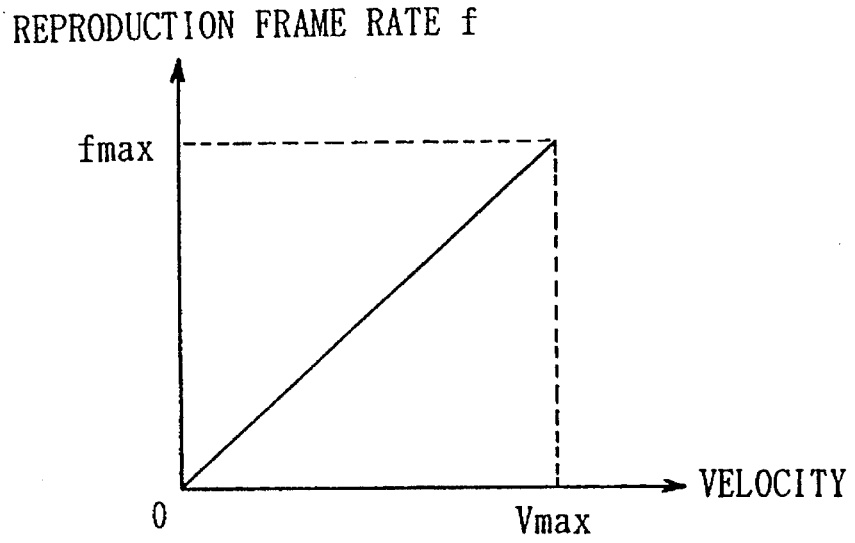
FIG. 30 is a graph showing the relationship between the car velocity and reproduction frame rate.

While the car 6 moves upward or downward between floors, the car undergoes such velocity variation that the velocity increases from zero, then remains constant after reaching a maximum Vmax and thereafter decreased to zero as shown in FIG. 29, so that when the reproduction frame rate is altered in proportion to the speed variation as seen in FIG. 30, the velocity of the car 6 matches the approaching velocity of the subject, enabling the passenger to sense the speed variation of the car 6 with reference to the image. If the time axis of signal reproduction is reversed between the ascent and descent of the car 6, an image is obtained in conformity with the direction of movement.

To alter the frame rate as stated above in the elevator system of FIG. 27, the output terminal of the coded data storage unit 142 is connected to a coded data memory 162, and a control circuit 172 is adapted to control data reading from the storage unit 142 and data writing to the memroy 162.

More specifically, a velocity signal is always fed from an elevator operation control unit 2 to the control circuit 172 via a communication I/F 109. The control circuit 172 first determines the frame rate f according to the velocity based on the relationship of FIG. 30. Next, the control circuit 172 calculates the number Fi of the frame to be read from the coded data storage unit 142, from Equation 2 below for upward movement of the car 6, and from Equation 3 for downward movement of the car 6.

Equation 2

$$Fi=S+\{i\times(f0/f1)\times(f/f0)\}$$ *as rounded to the nearest whole number*

Equation 3

$$Fi=S-\{i\times(f0/f1)\times(f/f0)\}$$ *as rounded to the nearest whole number*

In these equations, f1 is a frame rate which is dependent on the image display method of the display unit 5 and is, for example, 30 Hz in the case of the NTSC method, i is a frame number (0, 1, 2, . . .) increasingly changing at a rate, and S is the initial value of video frame number. (In the equations, the value in the brackets {} is rounded.)

Figures 31A, 31B, 31C:
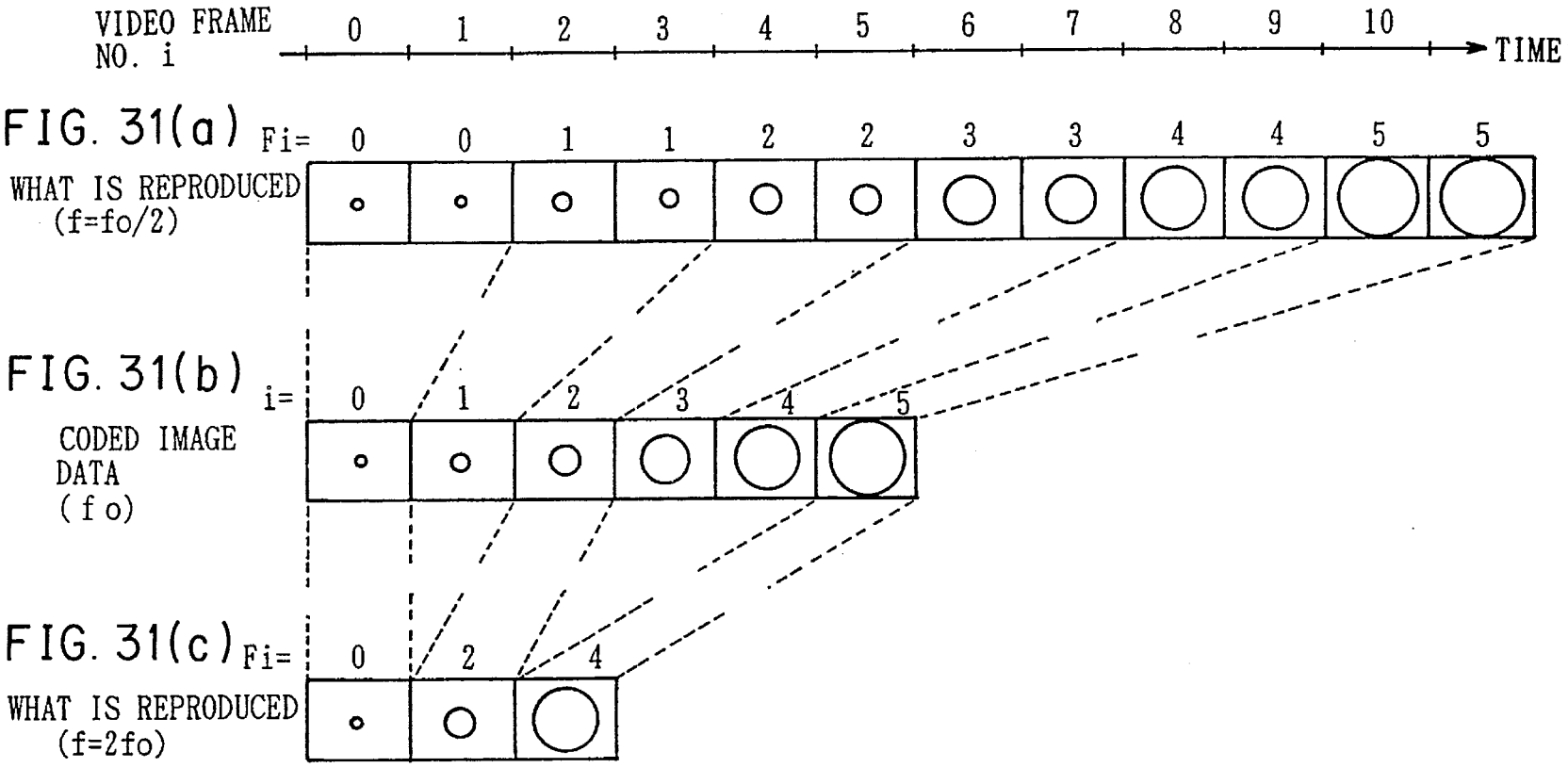
FIG. 31 is a diagram illustrating how images change at varying frame rates.

For example, FIG. 31, (b) shows an image of approaching tunnel outlet as recorded at the frame rate f0. When the frame rate f for reproduction is set, for example, at ½ of the recording frame rate f0, the frame number Fi changes in the manner of 0, 0, 1, 1, 2, 2, . . . as shown in the same drawing, (a). Thus, the image of the same drawing (b) is reproduced at a slow speed, i.e., ½ of the recording speed.

Further when the frame rate f for reproduction is set at twice the recording frame rate f0, the frame number Fi changes in the manner of 0, 2, 4, . . . as shown in FIG. 31, (c), and the image of the same drawing (b) is reproduced fast at twice the speed.

When the frame number Fi thus determined is fed to the coded data storage unit 142, the image data having the frame number is read from item to item from the storage unit 142 and stored in the coded data memory 162.

The data in the memory 162 is read therefrom by the control circuit 172 and further fed to a decoding circuit 108, by which the data is decoded to an analog image signal for one picture with a period of 1/f1.

The image signal for one picture is stored in a first video memory 163 and second video memory 164 alternately with a cycle of 1/f1 and read therefrom alternately with a cycle of 1/f1 by operating first and second change-over switches 173, 174. At this time, the data is written to the memory which is not in use for data reading by virtue of the interlocked operation of these switches 173, 174.

The image signal read from the first and second video memories 163, 164 alternately is converted to a specified format by a video I/F 191 and thereafter fed to the image display unit 5.

Figure 28:
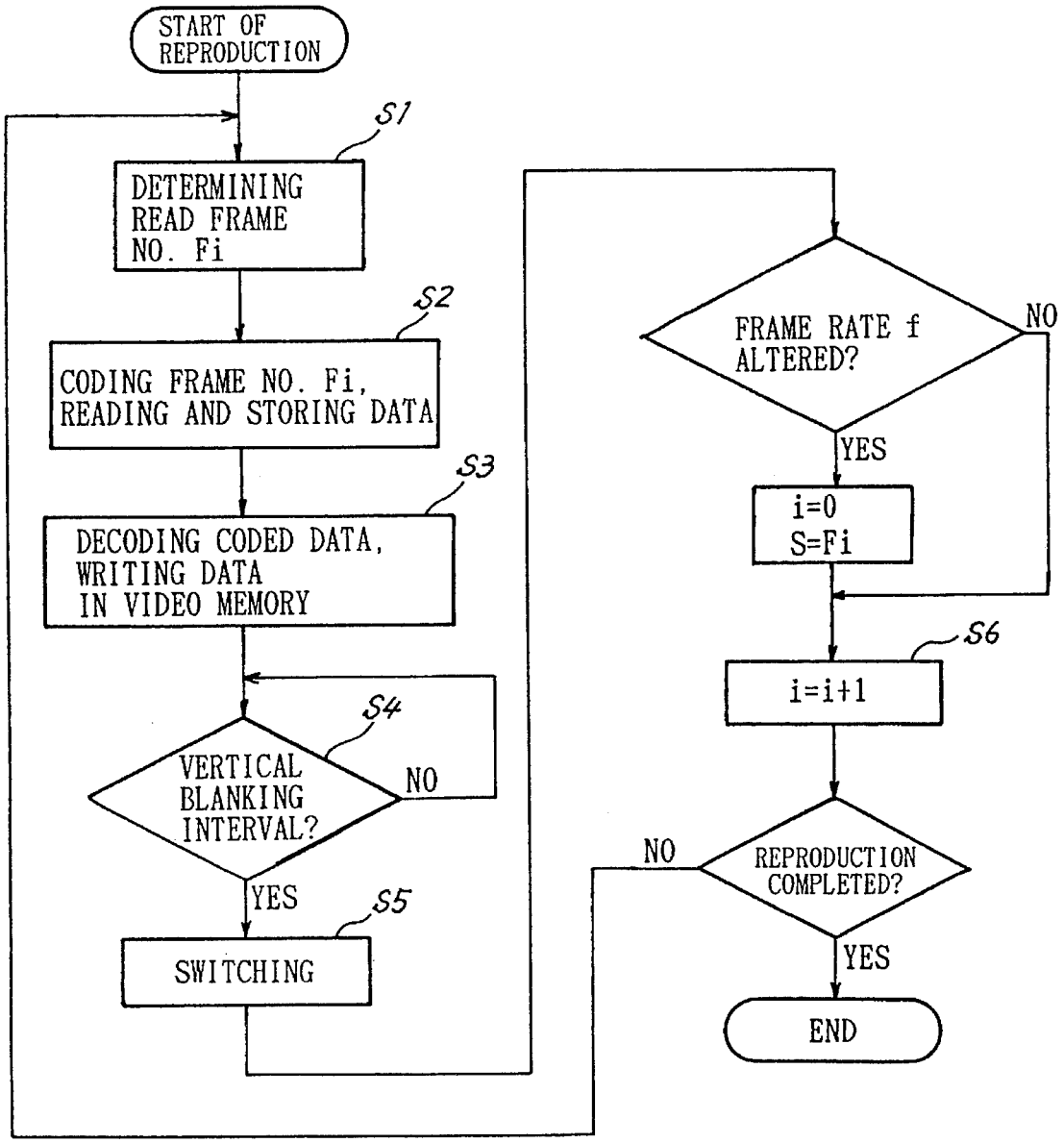
FIG. 28 is a flow chart showing an image control procedure employed in the embodiment.

FIG. 28 shows the control procedure to be executed by the control circuit 172. First, the frame number Fi to be read is determined according to Equation 2 or 3 based on the velocity signal available from the elevator operation control unit 2 (S1). The coded data having the frame number is read from the image source storage unit 141 and stored in the coded data memory 162 (S2). The coded data is then read therefrom and decoded. The decoded image signal is written to either one of the video memories (S3). The video signal is thereafter checked for vertical blanking interval (S4), and the two switches are operated for a change-over during the interval (S5).

An inquiry is then made as to whether the frame rate has been altered. If the answer is affirmative, the video frame number i in Equation 2 or 3 is set to 0, and the initial value S of video frame number is read out and set to the frame number Fi. Subsequently, the video frame number i is incremented (S6). The above procedure is repeated until image reproduction is completed, for example, with the cessation of operation of the elevator.

Consequently, the image display unit 5 shows an image of the subject moving toward or away from the viewer at varying speeds in conformity with variations in the velocity of the car 6.

With the elevator system described, the image shown on the display unit 5 enables the passenger to visually sense variations in the velocity of the car 6, makes the passenger feel as if he were present in the site shown and therefore arrests the eyes of many passengers.

Fifth Embodiment

Figure 32:
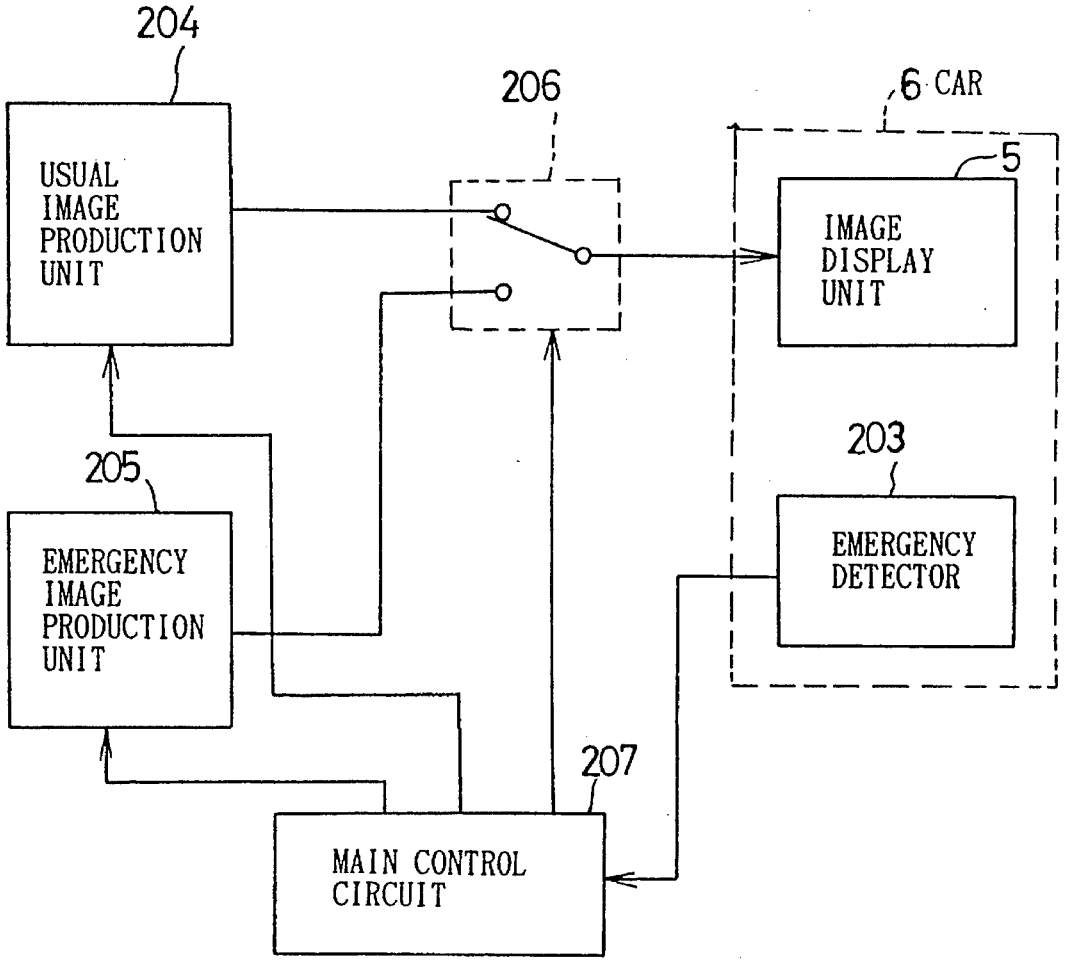
FIG. 32 is a block diagram showing the construction of an elevator system of the invention adapted to notify occurrence of an emergency.

FIG. 32 shows an elevator system which comprises an image display unit 5 provided in an elevator car 6, and an emergency detector 203 disposed in the car for detecting an emergency occurring in the operation of the elevator. Connected to the display unit 5 via a change-over unit 206 are a usual image production unit 204 for feeding a first image signal to the display unit 5 while the elevator is in normal operation, and an emergency image production unit 205 operable in the event of an emergency for feeding a second image signal as to the emergency to the unit 5.

A main control circuit 207 controls the operation of the usual and emergency image production units 204, 205 and the change-over operation of the unit 206. Upon detecting occurrence of an emergency, the detector 203 feeds an emergency detection signal to the main control circuit 207, which in turn operates the emergency image production unit 205 and, at the same time, closes the change-over unit 206 for connection to the unit 205 to display an image for emergency use on the display unit 5.

Figure 33:
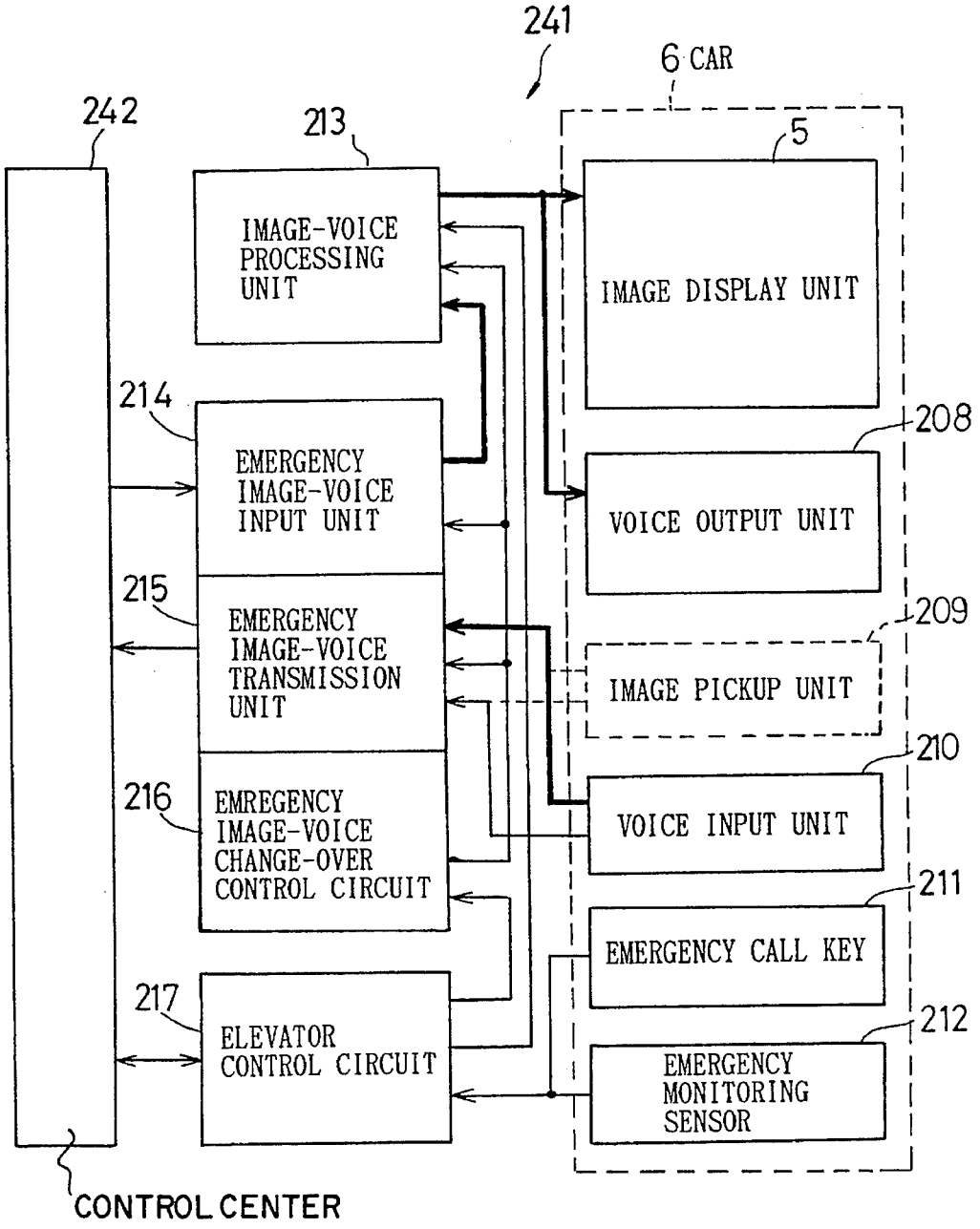
FIG. 33 is a block diagram showing the construction of the elevator system in greater detail.
Figure 34:
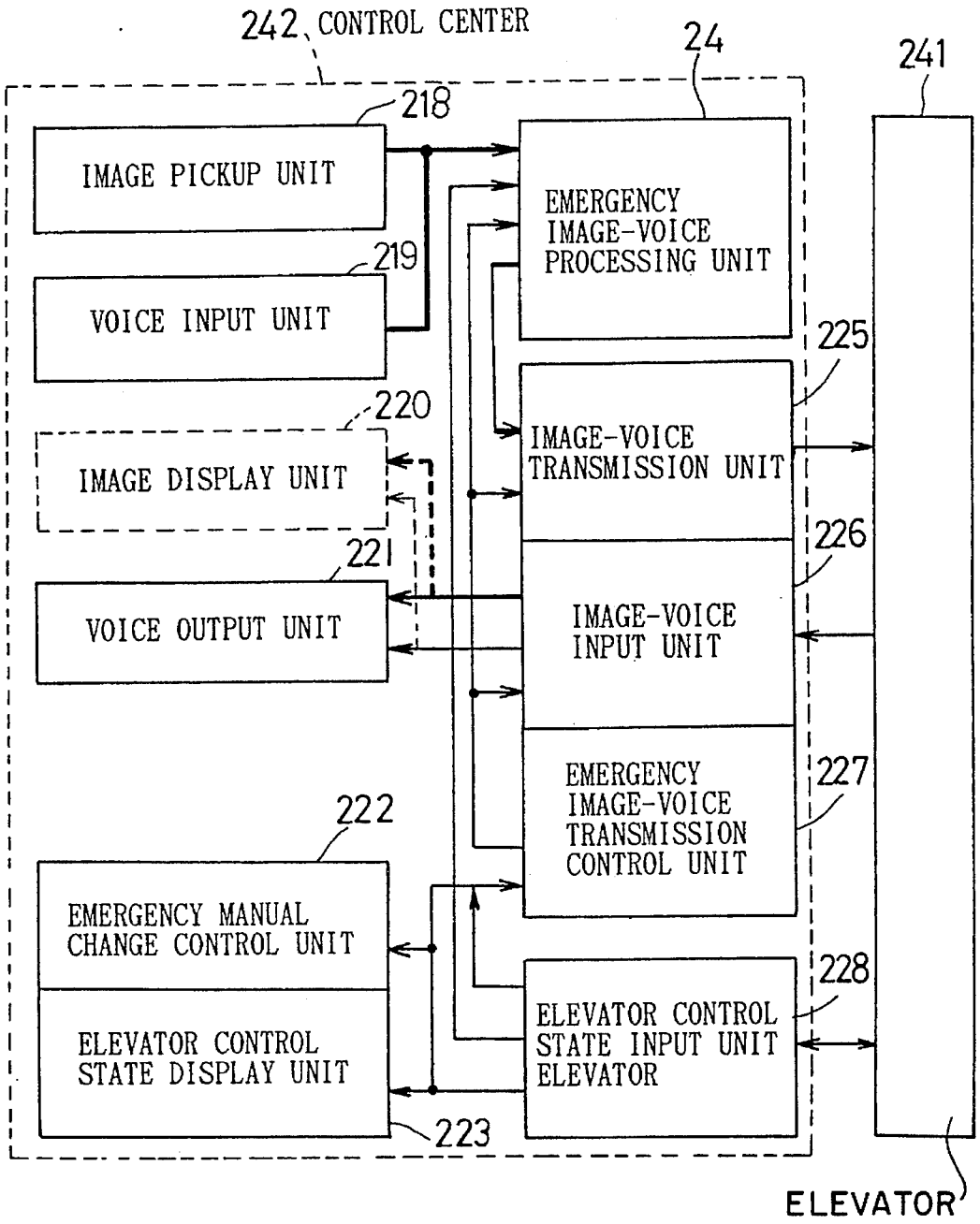
FIG. 34 is a block diagram showing specific components of a control center.

FIGS. 33 and 34 show the construction of the elevator system in greater detail. The elevator 241 and a control center 242 are interconnected by an external line.

With reference to FIG. 33, the car 5 of the elevator 241 has arranged therein the display unit 5 which comprises a liquid crystal projector, CRT or the like, a voice output unit 208 for outputting voice from the control center 242, a voice input unit 210 for sending the passenger's voice to the control center 242 and an image pickup unit 209 for sending an inside image of the car to the center 242 when required.

The image display unit 5 and the voice output unit 208 have connected thereto an image-voice processing unit 213, which has recorded therein image and sound sources, such as environmental images and background music, for attracting the eyes of passengers or relieving tension during the normal operation. The image and sound sources can be supplied from outside the elevator system through an external line.

The image-voice processing unit 213 feeds an image signal and a voice signal respectively to the display unit 5 and output unit 208 within the car 6 via transmission lines. An elevator control circuit 217 for controlling the upward and downward movement of the car 6 feeds to the processing unit 213 data representing the operating state of the elevator, such as the number of the floor at which the car 6 comes to a stop. The image-voice processing unit 213 super-imposes the operating state data on the image of the image source, feeds the resulting image signal to the display unit 5 and delivers the voice or sound signal of the sound source to the voice output unit 208.

Thus, an image including floor indication and agreeable music or the like is furnished inside the car 6 to relieve the passenger of tension.

In the event of an emergency, on the other hand, a report signal produced by an emergency call key 211 provided inside the car 6 and an alarm signal from an emergency monitoring sensor 212 disposed in a suitable inside or outside portion of the car 6 are sent via the control circuit 217 to the control center 242 where an operation control attendant is usually stationed. (The report signal and the alarm signal will collectively be referred to as an "emergency signal.")

The control circuit 217 feeds the emergency signal to an emergency image-voice change-over control circuit 216 serving as the above-mentioned change-over unit 206 for the circuit 216 to control the operation of the image-voice processing unit 213, an emergency image-voice input unit 214 and emergency image-voice transmission unit 216.

In the event of an emergency, the circuit 216 brings the processing unit 213 out of the operation while actuating the input unit 214 and the transmission unit 215 into operation for the input unit 214 to accept an image signal and voice signal from the control center 242. The image pickup unit 209 and the voice input unit 210 delivers an image signal and voice signal to the control center 242 via the transmission unit 215.

The image signal and voice signal accepted by the emergency image-voice input unit 214 are fed via the processing unit 213 to the image display unit 5 and the voice output unit 208, respectively.

Consequently, the display unit 5 shows an image from the control center 242. At the same time, the voice output unit 208 releases a voice from the center 242.

As shown in FIG. 34, the control center 242 is provided with an image pickup unit 218 for picking up an image of the operation control attendant himself and a voice input unit 219 for inputting the voice of the attendant. The image and voice are fed to an image-voice transmission unit 225 via an emergency image-voice processing unit 224. A VTR or like recorder can be incorporated into the processing unit 224. In this case, the image and voice for emergency use can be recorded in the VTR in advance.

The image signal and voice signal fed to the transmission unit 225 are sent to the elevator 241 by way of the external line. In the case where the car 6 has the image pickup unit 209 as stated above, the control center 242 has installed therein an image display unit 220 for presenting the image from the pickup unit 209. A speaker or like voice output unit 221 is further installed in the control center 242.

The emergency signal from the elevator 241 is fed via an elevator control state input unit 228 to an elevator control state display unit 223 and also to an emergency image-voice transmission control circuit 227 at the same time. Inside the center 242, the display unit 223 shows the operating state of the elevator.

The control circuit 227 controls the operation of the emergency image-voice processing unit 224, image-voice transmission unit 225 and image-voice input unit 226.

More specifically in the event of an emergency, the processing unit 224 delivers an image signal and voice signal to the elevator 241 via the transmission unit 225. At the same time, an image signal and voice signal are transmitted from the elevator 241 to the image display unit 220 and voice output unit 221 via the image-voice input unit 226.

As a result, the image display unit 5 shown FIG. 33 displays the image of the operation control attendatnt, and at the same time, the voice output unit 208 releases the voice of the attendant. The passenger in the car can therefore feel at ease and follow the attendant's instructions.

Incidentally, the control center 242 has installed therein an emergency manual change control unit 222 for manually changing over the operation mode of the elevator to an emergency mode regardless of the emergency signal from the elevator control state input unit 228.

The position and posture in which the display unit 5 is installed are the same as those in the first embodiment and therefore will not be described again.

The foregoing description of the embodiments is given to illustrate the present invention and should not be contruded as limiting the invention as defined in the appended claims or reducing the scope thereof. The system of the invention is not limited to the above embodiments in contruction or features but can be modified variously by one skilled in the art without departing from the spirit of the invention set forth in the claims.

What is claimed is:

1. An elevator system having an elevator operation control unit for controlling the upward or downward movement of an elevator car and an image display unit provided inside the car, the elevator system comprising an image reproduction unit for feeding a main image signal for forming a background image to the image display unit, a superimposition image production circuit for producing a subimage signal for forming a floor indicating image based on a floor signal from the elevator operation control unit and a direction indicating image showing whether the car is in an upward or downward movement based upon an elevator operation data obtained from the operation control unit, and an image composition unit for combining the main image signal and the subimage signal into a composite image signal to superimpose the floor indicating image on the background image and feeding the composite image signal to the image display unit.

2. An elevator system as defined claim 1 wherein the image display unit has a display screen positioned inside the car above entrance-exit doors in a slating posture to oppose the eyes of passengers.

3. An elevator system having an image display unit provided inside an elevator car, the car being provided with a slanting wall joined to a side of a horizontal ceiling and disposed in an inclined posture to oppose the eyes of passengers, the image display unit comprising a display screen installed in the slanting wall for images to be projected thereon from behind, an image projector installed on the ceiling and a light reflector for reflecting an image projected thereon from the projector and guiding the image to the rear side of the display screen.

4. An elevator system as defined in claim 3 wherein the image display unit has connected thereto a circuit for showing a floor indicating image on the display screen based on a floor signal from an elevator operation control unit.

5. An elevator system having an image display unit provided inside an elevator car, the car being provided with a plurality of slanting walls each joined to a side of a horizontal ceiling and disposed in an inclined posture to be opposed to the eyes of passengers, the image display unit comprising a plurality of display screens installed in the respective slanting walls for images to be projected thereon from behind, a single image projector installed on the ceiling and a light distributor for dividing the light of an image projected thereon from the projector and guiding the image to the rear side of each of the display screens.

6. An elevator system as defined in claim 5 wherein the image display unit has connected thereto a circuit for showing a floor indicating image on each display screen based on a floor signal from an elevator operation control unit.

7. An elevator system having an elevator operation control unit for controlling the upward or downward movement of an elevator car and an image display unit provided inside the car, the elevator system comprising an image source storage unit having recorded therein an image corresponding to the position of the car in upward or downward movement, a video memory capable of storing a plurality of fields of image signal to be reproduced from the image source storage unit, and a control circuit for controlling signal writing to and reading from the video memory and controlling a display of the read image signal on the image display unit, the control circuit comprising means for obtaining data as to the position of the car based on a position signal from the elevator operation control unit, means for reproducing from a recording area of the image source storage unit signals of two selected fields of image corresponding to the car position based on the position data obtained and writing the image signal to the video memory, and means for reading the signal from the video memory to prepare an image signal for a single picture which is a combination of said two selected fields of image, and therefore continuous to said two selected fields of image, and controlling the display of the image signal on the image display unit, the display of the image signal on the image display unit being continuous at each floor and at intermediate positions of the car.

8. An elevator system as defined in claim 7, wherein the image source storage unit has recorded therein a plurality of still pictures assigned respectively to floors where the car stops, and at least two of the still pictures assigned to two floors, said two floors being one floor above and one floor below the position of the car, are written to the video memory and are displayed on the display unit upon change-over in corresponding relation to the position of the car.

9. An elevator system as defined in claim 8 wherein the two still pictures written to the video memory are combined into a composite image and the composite image is shown on the display unit during movement of the car.

10. An elevator system as defined in claim 7, wherein the image source storage unit has recorded therein different kinds of animations in a sequential configuration, assigned respectively to floors where the car stops, and at least two of the animations in sequence assigned to two floors, said two floors being one floor above and one floor below the position of the car, are written to the video memory only for a plurality of fields including the field of current time and are shown on the display unit as a continuous image upon change-over in corresponding relation to the position of the car and the current time.

11. An elevator system as defined in claim 10 wherein the two animations written to the video memory are combined into a composite image and the composite image is shown on the display unit during movement of the car.

12. An elevator system having an elevator operation control unit for controlling the upward or downward movement of an elevator car and an image display unit provided inside the car, the elevator system comprising an image source storage unit having recorded therein a first image representing the opening-closing movement of doors of the car and a second image corresponding to a background for the position of the car, a video memory capable of storing the first and second image signals signal to be reproduced from the image source storage unit, and a control circuit for controlling the first and second image signals writing to and reading from the video memory and controlling a display of the read image signal on the image display unit, the control circuit comprising means for reproducing from a recording area of the image source storage unit the first and second image signals based on a door opening-closing signal obtained from the elevator operation control unit which recording area corresponds to the opening-closing signal and the position of the car, means for reading the signal from the video memory for combining the first and the second image signals into a composite image signal based on the position of the car and controlling the display of the signal on the image display unit.

13. An elevator system as defined in claim 12 wherein the image source storage unit has recorded therein a first image signal representing the door opening-closing operation of the car and a second image signal for displaying a background for fully open doors, and the control circuit has means for combining the first and second image signals into a composite image signal on the video memory based on the door opening-closing signal obtained from the elevator operation control unit.

14. An elevator system having an elevator operation control unit for controlling the upward or downward movement of an elevator car and an image display unit provided inside the car, the elevator system comprising a coded data storage unit wherein an image of a subject approaching or moving away at a constant speed is recorded as coded for every frame number, a coded data memory for storing the data to be read from the storage unit, a decoding circuit for decoding the data read from the coded data memory, a signal processing circuit for preparing an image signal for one picture from a signal output from the decoding circuit, and a control circuit for controlling data reading from the coded data storage unit and data reading from the coded data memory, the control circuit comprising means for determining a frame number in accordance with the velocity of movement of the car based on an elevator velocity signal obtained from the elevator operation control unit, and means for reading the data of the frame number determined from the coded data storage unit and writing the data to the coded data memory.

15. An elevator system having an image display unit inside an elevator car and comprising:

an emergency detector for detecting an emergency when the operation of the elevator has developed the emergency, a usual image production unit for feeding a first image signal to the image display unit while the elevator is in normal operation, an emergency image production unit for feeding a second image signal as to the emergency to the image display unit in the event of the emergency, a change-over unit for connecting an output terminal of the usual image production unit or the emergency image production unit alternatively to an input terminal of the image display unit upon a change-over, and a main control circuit for controlling the change-over operation of the change-over unit;

wherein the emergency image production unit is provided in a control center for monitoring the operating state of the elevator and comprises a unit for picking up an image of an operation control attendant, the control center having a voice input unit disposed therein for inputting the voice of the attendant, the elevator car having a voice output unit disposed therein along with the image display unit, so that an image signal from the image pickup unit is fed to the image display unit and a voice signal from the voice input unit is fed to the voice output unit at the same time.

* * * * *

UNITED STATES PATENT AND TRADEMARK OFFICE

CERTIFICATE OF CORRECTION

PATENT NO. : 5,485,897

DATED : January 23, 1996

INVENTOR(S) : MATSUMOTO et al.

It is certified that error appears in the above-indentified patent and that said Letters Patent is hereby corrected as shown below:

Title Page:

[75] delete "Atsuo Nishigakik" and insert therefor --Atsuo Nishigaki-- delete "Osakaseayama" and insert therefor --Osakasayama--.

Signed and Sealed this

Thirtieth Day of July, 1996

Bruce Lehman

*Attest:*

BRUCE LEHMAN

*Attesting Officer*

*Commissioner of Patents and Trademarks*